US006620265B2

(12) United States Patent
Kawahara et al.

(10) Patent No.: US 6,620,265 B2
(45) Date of Patent: Sep. 16, 2003

(54) METHOD FOR MANUFACTURING AN ALUMINUM ALLOY FIN MATERIAL FOR BRAZING

(75) Inventors: Akira Kawahara, Tokyo (JP); Takeyoshi Doko, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 10/152,922

(22) Filed: May 20, 2002

(65) Prior Publication Data

US 2003/0015573 A1 Jan. 23, 2003

Related U.S. Application Data

(63) Continuation of application No. PCT/JP01/10517, filed on Nov. 30, 2001.

(30) Foreign Application Priority Data

Dec. 13, 2000 (JP) ..... 2000-379185
Sep. 13, 2001 (JP) ..... 2001-278658

(51) Int. Cl.[7] ..... C22C 9/01; C22F 1/04; B22D 11/00; B23K 1/19

(52) U.S. Cl. ..... 148/551; 148/550; 148/552; 148/437; 164/476; 228/262.5

(58) Field of Search ..... 228/173.2–173.4, 228/173.6, 183, 193, 196, 262.1, 262.5, 117, 235.2, 235.3; 148/437, 550–552; 164/476

(56) References Cited

U.S. PATENT DOCUMENTS 3,989,548 A * 11/1976 Morris ..... 148/437
4,325,755 A * 4/1982 Blade et al. ..... 148/438
4,511,632 A * 4/1985 Toma et al. ..... 420/535
4,614,224 A * 9/1986 Jeffrey et al. ..... 164/476
4,906,534 A * 3/1990 Bekki et al. ..... 148/416
4,929,421 A * 5/1990 Jin et al. ..... 148/437
5,476,725 A * 12/1995 Papich et al. ..... 148/523
5,669,436 A * 9/1997 Papich et al. ..... 164/461
5,714,019 A * 2/1998 Sanders et al. ..... 148/552
5,833,775 A * 11/1998 Newton et al. ..... 148/551
6,165,291 A * 12/2000 Jin et al. ..... 148/551
6,280,543 B1 * 8/2001 Zonker et al. ..... 148/551
2002/0043311 A1 * 4/2002 Selepack et al. ..... 148/551

FOREIGN PATENT DOCUMENTS

JP 02-299714 A * 12/1990
JP 03-031454 2/1991
JP 03-100143 4/1991
JP 07-216485 8/1995
JP 08-104934 4/1996
JP 08-143998 A * 6/1996
JP 10-152762 A * 6/1998
JP 2000-303156 10/2000
WO WO 00/05426 2/2000

* cited by examiner

*Primary Examiner*—Tom Dunn
*Assistant Examiner*—L. Edmondson
(74) *Attorney, Agent, or Firm*—Knobbe Martens Olson & Bear LLP

(57) ABSTRACT

A method for manufacturing an aluminum alloy fin material brazing comprises forming an ingot sheet by casting a molten liquid of an aluminum alloy by a continuous casting rolling method, and cold-rolling the ingot sheet to prepare a fin material. The aluminum alloy contains prescribed amounts of Mn, Fe, and Si, with the balance being Al and inevitable impurities. The continuous cast-rolling is applied under each a prescribed condition of a molten liquid temperature, a roll press load, a casting speed, and a thickness of the ingot sheet. Two or more intermediate annealings are applied midway in the cold-rolling process, with intermediate annealing including final intermediate annealing with a heating furnace in prescribed temperature range, thereby adjusting the prescribed rolling ratio in the cold-rolling, after the final intermediate annealing.

32 Claims, 5 Drawing Sheets

General view

Partially enlarged view

METHOD FOR MANUFACTURING AN ALUMINUM ALLOY FIN MATERIAL FOR BRAZING

This is a continuation of PCT Application PCT/JP01/10517, filed Nov. 30, 2001. The prior PCT application was not published in English under PCT Article 21(2).

TECHNICAL FIELD

The present invention relates to a method for manufacturing an aluminum alloy fin material for brazing, using a twin-roll-type continuous cast-rolling method (or abbreviated as a continuous cast-rolling method) and cold-rolling.

BACKGROUND ART

A heat exchanger made of an aluminum alloy, such as a radiator, assembled by brazing, has a corrugated fin 2 integrated between flat tubes 1, as shown in FIG. 1, and both ends of the flat tube are open to the spaces formed by a header 3 and a tank 4. A heated refrigerant is sent into the flat tube 1 from one of the tanks, and the cooled refrigerant, by heat exchange at the part of the flat tube 1 and fin 2, is collected into the other tank, to be recirculated.

An extrusion flat tube having multi-pore, a plate manufactured by press-molding of a brazing sheet, in which a core material is clad with a sheath material (such as a brazing material of an Al—Si-series alloy), or an electro-seam welding flat tube, is used for the above-described tube 1. A fin comprising a brazing sheet manufactured by cladding the sheath material onto both surfaces of the core material, or a fin comprising an Al—Mn-series alloy (such as 3003 alloy or 3203 alloy) excellent in buckling resistance, is used for the above-described fin.

Since the heat exchanger has been required to be of small size and light weight in recent years, the fin material constituting the heat exchanger tends to be thin. Consequently, the fin material is emphasized to have improved mechanical strength, because the fin may collapse during assembly of the heat exchanger, or the radiator may break during use when the mechanical strength of the fin material is insufficient. In addition, improvement of heat conductivity of the fin material itself has been required, since the amount of heat transport of the fin material is thought to be important as a result of thinning of the fin material in response to the small size and light weight of the heat exchanger, such as a radiator.

However, the conventional Al—Mn-series alloy fin material has the problem that an increased Mn content, to enhance the mechanical strength of the fin material, leads to a large decrease in heat conductivity. On the other hand, an increased Fe content results in crystallization of a large quantity of intermetallic compounds, which works as recrystallization nuclei when the fin material recrystallizes by brazing, to form fine recrystallization textures. Since this fine recrystallization texture involves many crystal grain boundaries, a problem is caused that the brazing material diffuses along the crystal grain boundaries during the brazing step, thereby decreasing the droop resistance of the fin material.

An Al—Fe—Ni-series alloy fin material (JP-A-7-216485 ("JP-A" means unexamined published Japanese patent application), JP-A-8-104934, and the like), which is proposed other than the above-described Al—Mn-series alloy fin material, is excellent in mechanical strength and heat conductivity. However, the alloy is not suitable for thinning, because self-corrosion resistance of the fin material itself is lowered.

Several fin materials according to the manufacturing method by continuous cast-rolling and cold-rolling have been proposed, since the method requires low plant investment. For example, an Al—Mn—Si-series alloy fin material (JP-A-8-143998) has been proposed, to prevent fatigue strength from decreasing, wherein primary crystal Si is allowed to localize at the center in the direction of thickness, by continuous cast-rolling and cold-rolling, and recrystallized grains are coarsened by preventing the primary crystal Si from working as recrystallization nuclei, thereby suppressing invasion of the brazing material into the crystal grain boundaries.

Other examples include an Al—Mn—Fe—Si-series alloy fin material (WO 00/05426), in which mechanical strength and electrical conductivity are enhanced by prescribing the cooling rate in the continuous cast-rolling; and an Al—Mn—Fe-series alloy fin material (JP-A-3-31454), in which brazing properties are improved by removing an oxidation film, formed by continuous cast-rolling, by alkali cleaning before or during the cold-rolling step.

However, most of Si has been crystallized as the primary crystal Si during the casting step in the invention disclosed in the above-described JP-A-8-143998. Consequently, the material may break during the rolling step, by forming the primary crystal Si that works as initiation points, or the fin material may break during the corrugation process. The thinner fin material is more readily broken during the corrugation process, and sometimes the fin material cannot be machined at all. In these cases, since the amount of Si incorporated into crystallized materials is small, to cause a depletion of crystallization nuclei (an Al—Fe—Mn—Si-series intermetallic compound) in the intermediate annealing step, or since precipitation of the intermetallic compound is further suppressed without hot-rolling or batch-type intermediate annealing step, the amount of Mn in the solid solution increases, to result in decreased heat conductivity. Further, since Si is segregated at the center of the fin material, the fin material becomes poor in fin melt resistance.

While the object of the invention in the above-described WO 00/05426 is to enhance precipitation by forming Mn-series fine intermetallic compounds, and to improve heat conductivity by precipitating Mn, a sufficient precipitation-enhancing effect has not been obtained, due to a smaller Mn content as compared with the present invention. When the Mn content is increased, to enhance precipitation, a coarse Mn-series compound (Al—Fe—Mn—Si compound) is precipitated, to decrease the corrugate formability. Since this fin material has a crystal grain diameter of as small as 30 to 80 $\mu$m after brazing, the fin melt resistance of the fin material decreases by diffusion of the brazing material. Furthermore, an Al—Fe—Si-series compound, as a cathode site, precipitates due to a small content of Mn, it decreases the self-corrosion resistance of the fin material itself.

The alloy composition of an invention in the above-described JP-A-3-31454 overlaps the composition of the present invention, either when the invention includes Si, or when the invention includes Si as well as any one of Cu, Cr, Ti, Zr or Mg. However, according to the method disclosed in the above-described publication, a Al—Fe—Mn—Si-series fine compound cannot be precipitated, even though the brazing ability of the fin material may be improved. Resultantly, various properties required for making the heat exchanger small in size and light in weight have not been satisfied.

Other and further features and advantages of the invention will appear more fully from the following description, taken in connection with the accompanying drawings.

DISCLOSURE OF THE INVENTION

The inventors of the present invention, studying intensively in view of the conventional techniques, have found that, by manufacturing a fin material from an Al—Mn—Fe—Si-series alloy having a prescribed composition by defining the temperature of the molten liquid, the roll press load, and intermediate annealing conditions in continuous cast-rolling, the resultant fin material includes a texture in which a large amount of fine Mn-series compounds (not containing a compound of size 0.8 $\mu$m or more) are deposited, to enable various properties required for the fin material to be improved. The present invention has been completed through further intensive studies based on the discovery above.

In applying the fin material for small-size and light-weight of heat exchangers, the fin material is required to satisfy various properties, such as mechanical strength, heat conductivity, sacrificial corrosion preventive effect, self-corrosion resistance, repeated stress resistance, fin-melt resistance, droop resistance, core-crack resistance, roll workability, fin-break resistance, and corrugate formability. Among these properties, (a) self-corrosion resistance, (b) repeated stress resistance, (c) fin-melt resistance, (d) core-crack resistance, and (e) fin-break resistance and corrugate formability will be described hereinafter.

(a) Self-corrosion resistance: Corrosion of the fin is classified into corrosion as a sacrificial anode material for protecting tubes by a potential difference arising between the fin and tube, and self-corrosion occurring in the fin itself.

When the alloy for the fin material contains a large amount of Ni, Fe and the like, the content of Fe-series compounds and Ni-series compounds, which work as cathode sites, increases, and easily progresses self-corrosion. The fin will disappear at an early stage when the self-corrosion resistance is low, and fail to provide an effect as a sacrificial anode material. Improving the self-corrosion resistance of the fin is important for thinning the fin.

Figure 1:
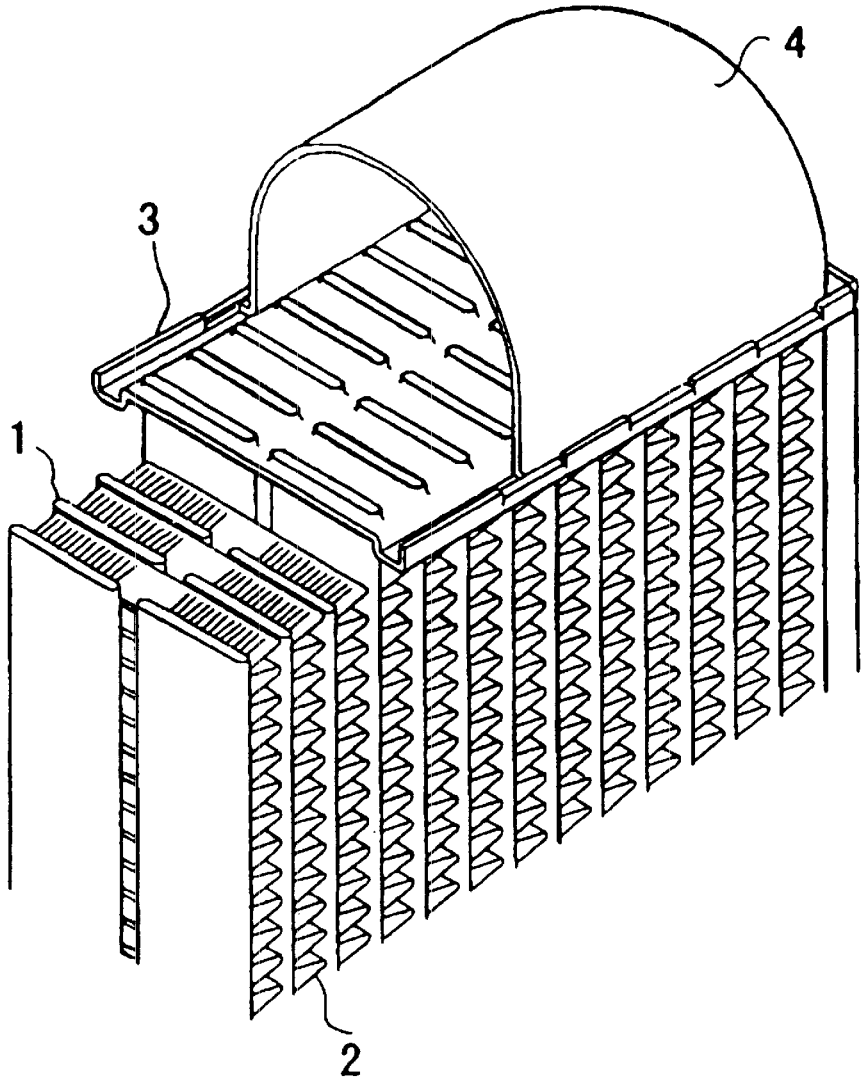
FIG. 1 is a perspective view showing one example of a radiator.

(b) Repeated stress resistance: The refrigerant for cooling is pressurized and circulated with a pump, in the heat exchanger (radiator), composed of the tube 1 and the fin 2, as shown in FIG. 1. The inside of the radiator comes under high pressure with the refrigerator, and it expands the cross-sectional configuration of the tube 1, thereby imparting tensile stress on the fin 2. When the tensile stress is repeatedly applied by starting and stopping of the pump, the fin 2 ultimately breaks from fatigue. The repeating number of stress applications before breakage by fatigue occurs is evaluated as "repeated stress resistance."

Breakage of the fin 2 by fatigue is not always equal to the mechanical strength of the fin material. For example, when particles are dispersed in the fin material, cracks are occurred around the particles, to decrease the repeated stress resistance.

Figure 2:
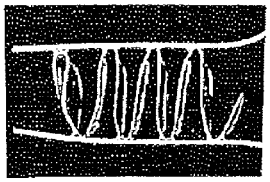
FIGS. 2(*a*), 2(*b*), 2(*c*), and 2(*d*) each are illustrative views of a melting of the fin, comprising an general view and a partially enlarged view thereof.
Figure 2:
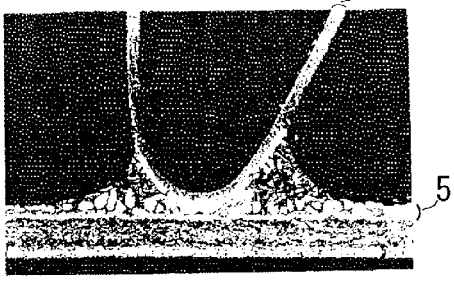
Figure 2:
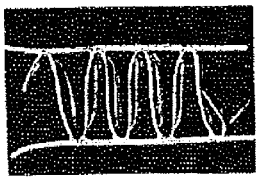
Figure 2:
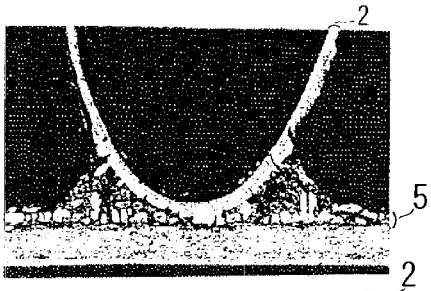
Figure 2:
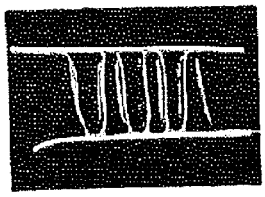
Figure 2:
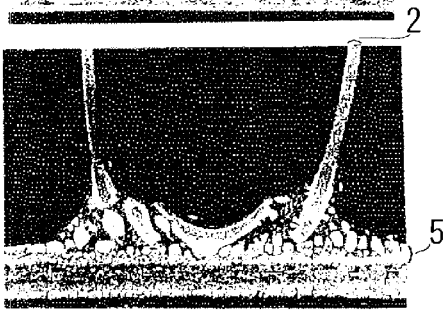
Figure 2:
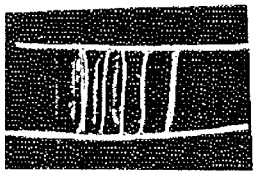
Figure 2:
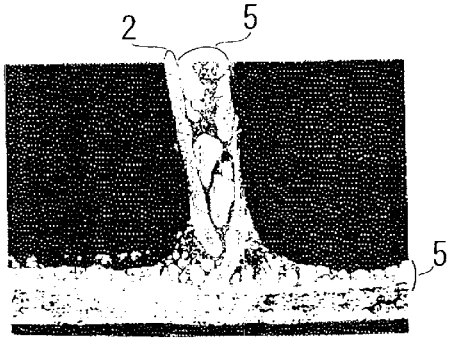

(c) Fin-melt resistance: Melting of the fin refers to a phenomenon in which the corrugated fin 2, as shown in FIG. 2(*a*), is gradually melted during the brazing process (from FIG. 2(*b*) to FIG. 2(*c*)). Multiple fins are integrated together by absorbing the brazing material 5 into the spaces among the fins, when this phenomenon advances (FIG. 2(*d*)).

Pressure-resistive strength of the heat exchanger decreases by melting of the fin. Fin melting is directly caused by allowing the brazing material at the core plate to flow to the fin side, to feed excess brazing material. This phenomenon is liable to occur, when the crystal grain size in the fin at the time of brazing is small, or when the content of Si in the alloy is large.

Figure 3:
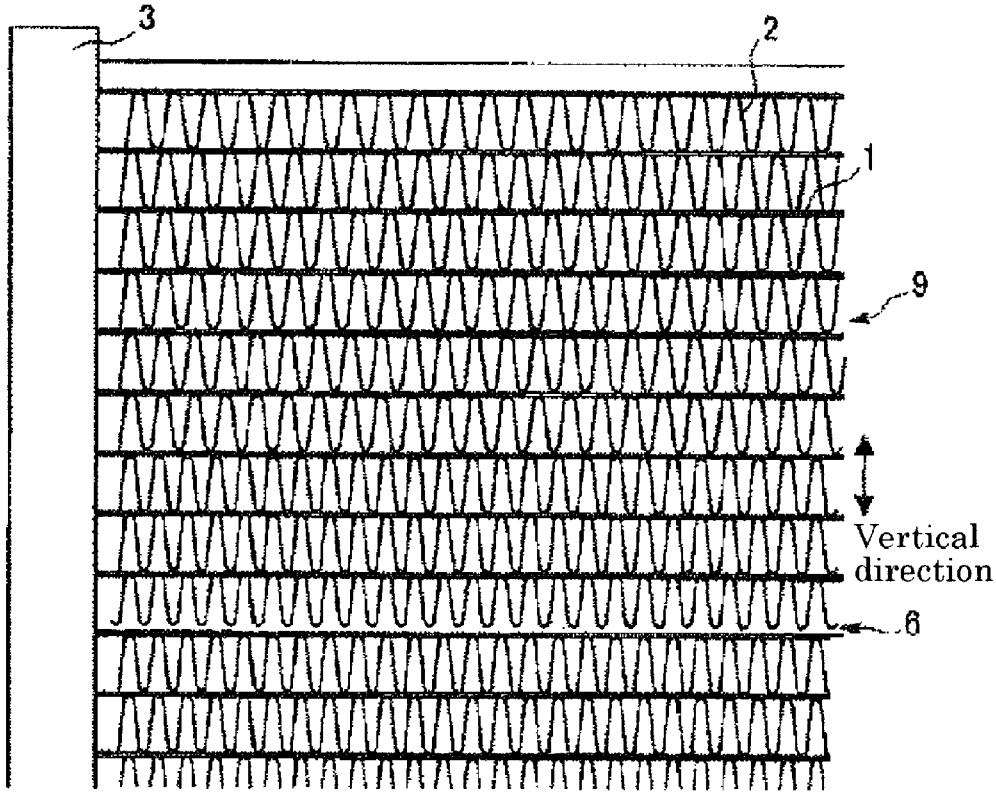
FIG. 3 is a partial schematic block view of core cracks occurred between the tube and fin after brazing.

(d) Core-crack resistance: Locally non-bonded portions (reference numeral 6 in FIG. 3) may appear between the tube and fin after brazing, when a thick brazing layer is coated on the tube-and fin material. In other words, the tube material shrinks in the vertical direction corresponding to the thickness of the brazing material layer, during heating for brazing. Since the core 9 is composed of the laminated tubes, the sum of length of shrinkage becomes several millimeters when the shrinkage length has accumulated by several tens steps in the vertical direction, thereby occurring the locally non-bonded portion 6. This locally non-bonded portion 6 is referred to as core crack. The mechanical strength of the entire core 9 is conspicuously reduced by occurring core cracks. Further, the sacrificial corrosion preventive effect of the fin 2 against the tube 1 at the core crack portion 6 is disappear.

(e) Fin-break resistance and corrugate formability: Breakage of a fin, as referred to herein, is a phenomenon of cutting of a fin material when a corrugated shape is formed by passing the fin material between two engaging roll gears. Such a breakage of the fin is liable to occur when an alloy element is added in a content beyond the level for forming a solid solution, and when a lot of dispersed particles are present in the alloy. Further, the breakage of the fin is liable to occur in a thinner fin. Further, corrugates formability is evaluated by the irregularity of the height of the fin. That is, the magnitude of spring-back is excessively increased by excessive mechanical strength (durability) of the fin material for forming the corrugated shape, thereby it causes irregular height of the resultant fin.

As mentioned above, the properties from (a) through (e) are essential characteristics for attaining thinning of a fin, i.e. small size and light weight in a resultant heat exchanger.

According to the present invention, there are provided the following means:

(1) A method for manufacturing an aluminum alloy fin material for brazing, comprising the steps of:
- forming an ingot sheet, by casting a molten liquid of an aluminum alloy by a twin-roll-type continuous cast-rolling method; and
- cold-rolling the ingot sheet, to prepare the fin material,
- with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, with the balance being Al and inevitable impurities,
- wherein said twin-roll-type continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, and wherein two times or more of intermediate annealing are applied midway in said cold-rolling process, with said intermediate annealing including final intermediate annealing with a batch-type heating furnace, in a temperature range of 300 to 450° C., and at a temperature that does not allow recrystallization to complete, thereby adjusting the rolling ratio in the cold-rolling, after the final intermediate annealing, to 10 to 60%;

(2) A method for manufacturing an aluminum alloy fin material for brazing, comprising the steps of:

forming an ingot sheet, by casting a molten liquid of an aluminum alloy by a twin-roll-type continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, as well as at least one of Zn of 3.0% by mass or less, In of 0.3% by mass or less, and Sn of 0.3% by mass or less, with the balance being Al and inevitable impurities, wherein said twin-roll-type continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, and wherein two times or more of intermediate annealing are applied midway in said cold-rolling process, with said intermediate annealing including final intermediate annealing with a batch-type heating furnace, in a temperature range of 300 to 450° C., and at a temperature that does not allow recrystallization to complete, thereby adjusting the rolling ratio in the cold-rolling, after the final intermediate annealing, to 10 to 60%;

(3) A method for manufacturing an aluminum alloy fin material for brazing, comprising the steps of:

forming an ingot sheet, by casting a molten liquid of an aluminum alloy by a twin-roll-type continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, as well as at least one of Cu of 0.3% by mass or less, Cr of 0.15% by mass or less, Ti of 0.15% by mass or less, Zr of 0.15% by mass or less, and Mg of 0.5% by mass or less, with the balance being Al and inevitable impurities, wherein said twin-roll-type continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, and wherein two times or more of intermediate annealing are applied midway in said cold-rolling process, with said intermediate annealing including final intermediate annealing with a batch-type heating furnace, in a temperature range of 300 to 450° C., and at a temperature that does not allow recrystallization to complete, thereby adjusting the rolling ratio in the cold-rolling, after the final intermediate annealing, to 10 to 60%;

(4) A method for manufacturing an aluminum alloy fin material for brazing, comprising the steps of:

forming an ingot sheet, by casting a molten liquid of an aluminum alloy by a twin-roll-type continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, at least one of Zn of 3.0% by mass or less, In of 0.3% by mass or less, and Sn of 0.3% by mass or less, as well as at least one of Cu of 0.3% by mass or less, Cr of 0.15% by mass or less, Ti of 0.15% by mass or less, Zr of 0.15% by mass or less, and Mg of 0.5% by mass or less, with the balance being Al and inevitable impurities, wherein said twin-roll-type continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, and wherein two times or more of intermediate annealing are applied midway in said cold-rolling process, with said intermediate annealing including final intermediate annealing with a batch-type heating furnace in a temperature range of 300 to 450° C., and at a temperature that does not allow recrystallization to complete, thereby adjusting the rolling ratio in the cold-rolling, after the final intermediate annealing, to 10 to 60%;

(5) A method for manufacturing an aluminum alloy fin material for brazing, comprising the steps of:

forming an ingot sheet, by casting a molten liquid of an aluminum alloy by a twin-roll-type continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, with the balance being Al and inevitable impurities, wherein said twin-roll-type continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, wherein one time or more of intermediate annealing is applied midway in said cold-rolling process, so that the final cold-rolling ratio becomes 10 to 95%, and wherein further annealing with a batch-type heating furnace is applied after said final cold-rolling, at a final sheet thickness in a temperature range of 300 to 450° C., and at a temperature that does not allow recrystallization to complete;

(6) A method for manufacturing an aluminum alloy fin material for brazing, comprising the steps of:

forming an ingot sheet, by casting a molten liquid of an aluminum alloy by a twin-roll-type continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less of Si, as well as at least one of 3.0% by mass or less of Zn, 0.3% by mass or less of In, and 0.3% by mass or less of Sn, with the balance being Al and inevitable impurities, wherein said twin-roll-type continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, wherein one time or more of intermediate annealing is applied midway in said cold-rolling process, so that the final cold-rolling ratio becomes 10 to 95%, and wherein further annealing with a batch-type heating furnace is applied after said final cold-rolling, at a final sheet thickness in a temperature range of 300 to 450° C., and at a temperature that does not allow recrystallization to complete;

(7) A method for manufacturing an aluminum alloy fin material for brazing, comprising the steps of:

forming an ingot sheet, by casting a molten liquid of an aluminum alloy by a twin-roll-type continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, as well as at least one of Cu of 0.3% by mass or less, Cr of 0.15% by mass or less, Ti of 0.15% by mass or less, Zr of 0.15% by mass or less, and Mg of 0.5% by mass or less, with the balance being Al and inevitable impurities, wherein said twin-roll-type continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, wherein one time or more of intermediate annealing is applied midway in said cold-rolling process, so that the final cold-rolling ratio becomes 10 to 95%, and wherein further annealing with a batch-type heating furnace is applied after said final cold-rolling, at a final sheet thickness in a temperature range of 300 to 450° C., and at a temperature that does not allow recrystallization to complete;

(8) A method for manufacturing an aluminum alloy fin material for brazing, comprising the steps of:

forming an ingot sheet, by casting a molten liquid of an aluminum alloy by a twin-roll-type continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, at least one of Zn of 3.0% by mass or less, In of 0.3% by mass or less, and Sn of 0.3% by mass or less, as well as at least one of Cu of 0.3% by mass or less, Cr of 0.15% by mass or less, Ti of 0.15% by mess or less, Zr of 0.15% by mass or less, and Mg of 0.5% by mass or less, with the balance being Al and inevitable impurities, wherein said twin-roll-type continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, wherein one time or more of intermediate annealing is applied midway in said cold-rolling process, so that the final cold-rolling ratio becomes 10 to 95%, and wherein further annealing with a batch-type heating furnace is applied after said final cold-rolling, at a final sheet thickness in a temperature range of 300 to 450° C., and at a temperature that does not allow recrystallization to complete;

(9) The method for manufacturing an aluminum alloy fin material for brazing according to any one of the items (1) to (8), wherein said intermediate annealing, except for the final annealing, is applied using a batch-type heating furnace or a continuous heating furnace; and

(10) An aluminum alloy fin material for brazing, wherein the crystalline texture of the fin material, which is obtained by the manufacturing method according to any one of the items (1) to (9), comprises a fibrous texture.

BEST MODE FOR CARRYING OUT THE INVENTION

The Al alloy constituting the fin material according to the present invention may contain Mn in a high concentration for improving the mechanical strength. However, since heat conductivity decreases when Mn is contained as a solid solution, Mn is allowed to crystallize and deposit as second phase dispersion particles by adding Si and Fe in the present invention. Furthermore, occurrence of primary crystallization of Si is suppressed in the present invention by prescribing continuous cast-rolling conditions, in order to allow Si to be finely dispersed as an intermetallic compound by adding Fe and Mn together. An ingot sheet of an Al—Mn—Fe—Si-series alloy is thus obtained by controlling Mn and Si to form a solid solution and to deposit. In the ingot sheet of the alloy, deposition of elements in the solid solution is further accelerated, by working Al—Fe—Mn—Si crystallized material, generated in continuous cast-rolling step, in cold-rolling and annealing steps thereafter, as nuclei.

Consequently, various properties such as mechanical strength, heat conductivity, sacrificial anode effect and self-corrosion resistance, as well as repeated stress resistance, fin-melt resistance, droop resistance, core-crack resistance, roll workability, fin-break resistance and corrugate formability, required for the fin material, are satisfied, thereby manufacturing a fin material that can be made thinner.

The fine material according to the present invention is only possible to be manufactured by satisfying all the alloy compositions and manufacturing conditions, which are defined in the present invention. The present invention is characterized by providing a thinned fin material maintaining high heat conductivity, in spite of its high content of Mn; a fin material being excellent in self-corrosion resistance, core-crack resistance, roll workability and fin-melt resistance, in spite of its high content of Fe; and a fin material being excellent in fin-melt resistance and fin-break resistance while maintaining high heat conductivity, in spite of its high content of Si. The fin material having the effect of the present invention cannot be obtained, when the manufacturing conditions are not satisfied even though the alloy composition satisfies, among the conditions defined in the present invention. On the contrary, the fin material having the effect of the present invention cannot be obtained, when the alloy composition is not satisfied even though the manufacturing conditions are satisfied.

The elements in the aluminum alloy to be used in the present invention will be described at first. However, the function of each elements is based on the prediction of manufacturing conditions defined in the present invention. It is repeated herein that the function cannot be obtained under manufacturing conditions without the definition of the present invention.

Mn is added for the following purposes in the present invention, in addition to improving mechanical strength.

Mn reacts with Fe simultaneously added in a large amount, to form an Al—Mn—Fe(—Si)-series compound, which suppresses an Al—Fe compound that works as a cathode side, from depositing, to improve self-corrosion resistance.

That is, in the present invention, since the high temperature molten liquid is subjected to continuous cast-rolling under a high pressure load with cooling at a high speed, Fe as an alloy element almost deposits as fine crystals of the order of 1 $\mu$m of the Al—Fe—Mn—Si-series compound or Al—Fe—Si-series compound. The above-described crystallized materials, are further finely divided in the following cold-rolling step, to contribute to improvement of mechanical strength of the fin material. While the Al—Fe—Si-series compound acts as a cathode site as a corrosion initiation point, Fe is deposited as the Al—Fe—Mn—Si-series compound in the present invention as a result of adding Mn. Subsequently, the Al—Fe—Mn—Si-series compound is deposited during the annealing step using the above-described divided crystallized materials as a nuclei. Since these intermetallic compounds hardly act as the cathode sites, they do not decrease self-corrosion resistance.

Since Mn is crystallized together with Si during the casting step in the present invention, Mn functions for suppressing crystallization of primary crystal Si. Suppressing primary crystal Si from crystallizing permits the repeated stress resistance, heat conductivity and fin-melt resistance to be improved.

The content of Mn is prescribed to be 0.6% by mass or more and 1.8% by mass or less, for allowing the foregoing effects to be exhibited. The effect of adding Mn is not fully manifested when the Mn content is 0.6% by weight or less, while heat conductivity and electrical conductivity are decreased at a Mn content of more than 1.8% by mass. The preferable Mn content is 0.7% by mass or more, for enhancing self-corrosion resistance of the fin material. The preferable upper limit of the Mn content is 1.4% by mass or less, for reducing the absolute amount of the intermetallic compound to enhance self-corrosion resistance.

Fe has been known as an element for forming an intermetallic compound during the casting step to thereby improve mechanical strength by enhanced dispersion without decreasing heat conductivity. Fe also serves for suppressing decrease of heat conductivity caused by adding Mn in the present invention, by combining the amount of addition of Si with manufacturing conditions.

Since maximum amount of Fe as a solid solution is small, it is crystallized as an intermetallic compound during the casting step. Fe reacts with Mn and Si to form the Al—Fe—Mn—Si-series compound in the present invention, thereby decreasing the amount of Mn and Si dissolved as a solid solution in the matrix. The proportions of Mn and Si in this intermetallic compound are more increased than those in the alloy manufactured by the conventional method, by combining the amount of Fe with the manufacturing method according to the present invention, in addition it results to fine and dense distribution of Fe in the alloy. The intermetallic compound, which is crystallized during the casting process with fine and dense distribution, also contributes for improving the mechanical strength by accelerating deposition of Mn and Si during the annealing step.

As mentioned above, heat conductivity is prevented from decreasing, and self-corrosion resistance of the fin material is improved in the present invention, by increasing the proportions of Mn and Si in the intermetallic compound.

According to the reasons described above, the content of Fe is defined to be more than 1.2% by mass and 2.0% by mass or less. The effect for preventing heat conductivity from decreasing by adding Mn is not sufficiently manifested when the Fe content is 1.2% by mass or less, while the Al—Fe-series compound crystallizes at an early stage when the Fe content exceeds 2.0% by mass, thereby decreasing the self-corrosion resistance. These crystallized materials arise break of the fin material during the cold-roll step and cutting of the fin in assembling the core, besides decreasing the droop resistance and fin-melt resistance by making crystallized materials fine. A Fe content of 1.3% by mass or more is preferable for enhancing the mechanical strength, while a Fe content of 1.8% by mass or less is preferable for decreasing the content of Fe in the intermetallic compound, thereby enhancing the self-corrosion resistance.

In the present invention, Si accelerates crystallization of a compound containing Fe and Mn formed during the casting step. Consequently, a large amount of addition of Si together with Mn and Fe can reduce the amount of Mn in the solid solution, thereby improving heat conductivity and electrical conductivity. Also, Si can prevent the self-corrosion resistance of the fin material from decreasing, by allowing Si to crystallize and deposit as an intermetallic compound having a large proportion of Mn. In addition, Si also serves for improving the mechanical strength and fin-break resistance, by accelerating deposition of Fe.

Thus, a large amount of Si can be added without decreasing heat conductivity in the present invention, by reducing the amount of Si in the solid solution.

Si can improve the fin-break resistance, mechanical strength, heat conductivity and self-corrosion resistance, as described above. The content of Si is defined to be more than 0.6% by mass and 1.2% by mass or less, because the effect of adding Si is not fully manifested when the Si content is less than 0.6% by mass. Further, when the Si content exceeds 1.2% by mass, on the other hand, the melting point of the fin material decreases to make the fin to be readily melted. In addition, a large content of Si permits Si to be crystallized at an early stage, to make the material to be readily broken during the continuous cast-rolling or cold-rolling step, along with easily causing cut of the fin during assembly of the core. The repeated stress resistance and heat conductivity also decrease under these conditions. Preferably, the Si content is 0.65% by mass or more, for enhancing heat conductivity, and a content of 0.75% by mass or more is more preferable. The upper limit of the Si content is preferably 1.0% by mass, for preventing the fin from melting during the brazing step.

Mn, Fe and Si are essential elements in the present invention as described above. The fin material having the following features can be obtained by satisfying all the combination of the amounts of addition of these elements and manufacturing conditions to be described hereinafter. The fin material maintains high heat conductivity, in spite of its high content of Mn; it is excellent in self-corrosion resistance, core-crack resistance, roll workability and fin-melt resistance, despite of its high content of Fe; and it is excellent in fin-melt resistance and fin-break resistance and maintains high heat conductivity, despite of its high content of Si.

The Al alloy constituting the fin material according to the present invention includes an Al alloy containing, in addition to the above-described essential elements of as Mn, Fe and Si, at least one of Zn, In and Sn that are effective for the sacrificial anode effect and/or at least one of Cu, Cr, Ti, Zr and Mg that are effective for improving mechanical strength.

While In and Sn among the above described Zn, In and Sn exhibit a sufficient sacrificial effect with a small amount of addition of them, they are expensive and recycling of scraps of them is difficult. Zn is an element involving no such problems, and the addition of Zn is most recommended for adjusting electrical potential of the fin material. The upper limits of the contents of the above-described Zn, In and Sn are defined to 3.0% by mass, 0.3% by mass and 0.3% by mass, respectively, because the corrosion resistance of the fin itself decreases when each content exceeds the above-described upper limit.

The above-described Cu, Cr, Ti, Zr and Mg each are able to contribute to the improvement of mechanical strength.

The upper limit of Cu is defined to 0.3% by mass, the upper limit of Cr is defined to 0.15% by mass, the upper limit of Ti is defined to 0.15% by mass, the upper limit of Zr is defined to 0.15% by mass, and the upper limit of Mg is defined to 0.5% by mass. This is because when the content of Cu exceeds the above-described upper limit, the corrosion potential of the alloy becomes noble, thereby the effect of the fin material as a sacrificial anode material decreases, and heat conductivity also decreases. When the contents of Cr, Ti and Zr exceed the above upper limits, respectively, the molten liquid feed nozzle may be clogged during the continuous cast-rolling step. The particularly preferable content of each of Cr, Ti and Zr is 0.08% by mass or less. When the content of Mg exceeds the above upper limit, Mg decreases brazing ability of the fin by reacting with the flux in the nocolock brazing step of the fin.

Zr also has a function to improve the droop resistance and fin-melt resistance of a fin material by coarsening recrystallized grains in the fin material.

In the present invention, since these elements exert adverse effects except for improvement of mechanical strength, their contents are preferably restricted to 0.03% by mass or less, that is, it is preferable that they are not substantially contained in the fin material.

Boron (B), that may be added for making the texture of the ingot fine, or other impurity elements may be contained in a total amount of 0.03% by mass or less, in the present invention.

The alloy composition that can be used in the present invention has been described above, and the manufacturing method will be described hereinafter.

In the present invention, the above-described Al alloy having the prescribed composition is made into an ingot sheet by the twin-roll-type continuous cast-rolling method, followed by applying cold-rolling and annealing, to manufacture the fin material.

The above-described twin-roll-type continuous cast-rolling method is known to include Hunter method, 3C method and the like, wherein the molten liquid of the aluminum alloy is fed from a feed nozzle of the molten liquid made of a refractory material, to between a pair of water-cooled rolls, followed by continuously cast-rolling the resultant thin sheet. The cooling speed is faster by 1 to 3 digits in the twin-roll-type continuous cast-rolling method, as compared with conventional DC casting methods.

The temperature of the molten liquid, the roll pressure load, the casting speed, and the thickness of the ingot sheet are prescribed in the above-described twin-roll type continuous cast-rolling according to the present invention. The metallic texture to be attained in the present invention is only obtained, by satisfying all the four conditions above, thereby enabling the properties of the fin material according to the present invention. The temperature of the molten liquid and the roll pressure load are particularly important among them.

The above-described temperature of the molten liquid means the temperature of the molten liquid in the head box in the twin-roll type continuous cast-rolling machine. The above-described head box is provided just before feeding the molten liquid to the molten liquid feed nozzle, and it is the portion for pooling the molten liquid to feed it stably to the twin-roll type continuous cast-rolling machine.

The twin-roll type continuous cast-rolling method is used in the present invention, because the twin-roll type continuous cast-rolling machine has been advanced in recent years, and manufacture under the conditions according to the present invention that would be difficult by using continuous cast-rolling machines, such as the conventional twin-roll type continuous cast-rolling machine, has became possible, thereby enabling the metallic texture to be attained in the present invention to obtain.

In the present invention, the first reason that the above-described temperature of the molten liquid is prescribed in the range of 700 to 900° C., is to allow the Al—Fe—Mn—Si-series intermetallic compound to be crystallized finely, as described in the above description on component composition. The proportion of Fe in the intermetallic compound increases at a temperature higher than the above-described upper limit temperature, thereby decreasing the self-corrosion resistance and heat conductivity of the fin material. In other words, since the maximum concentrations of Mn and Si in the solid solution are larger than that of Fe, crystallized materials containing Fe is hardly deposited when the temperature of the molten liquid is too high. In addition, when the temperature of the molten liquid is high, the molten liquid cannot be made supercooled, due to insufficient cooling ability of the continuous cast-rolling machine. Consequently, coarse crystallized materials containing Fe and Mn are deposited at near the center in the direction of thickness of the sheet, thereby decreasing the mechanical strength, fin-break resistance and core-crack resistance. On the other hand, when the temperature of the molten liquid is lower than the lower limit temperature, Si is crystallized at near the center in the direction of thickness of the sheet, to decrease the fin-melt resistance.

The second reason why the above-described temperature of the molten liquid is restricted in the range of 700 to 900° C. is that nuclei of crystallized materials are formed on the wall of the molten liquid feed nozzle when the temperature of the molten liquid is low, in the alloy according to the present invention containing a large amount of Fe and Mn. The crystallized materials that are further grown as coarse crystallized materials are separated from the molten liquid feed nozzle to be mingled with the ingot sheet, thereby causing break of fins in the core assembly step. These crystallized materials allow the droop resistance, repeated stress resistance, fin-melt resistance and core-crack resistance to be reduced. Casting may become impossible by clogging of the molten liquid feed nozzle by the crystallized materials, when the temperature of the molten liquid is further decreased.

As described above, the lower limit of the temperature of the molten liquid is adjusted to 700° C. that is far above the liquidus temperature, and the upper limit is prescribed to 900° C. For allowing the intermetallic compound having the effect of the present invention to be certainly distributed, the range of the above-described temperature of the molten liquid is particularly preferably 750 to 850° C.

Cut of the fin arises in the core assembly step, due to coarsening of the intermetallic compound when the roll pressure load is low, even by prescribing the temperature of the molten liquid as described above, thereby decreasing the repeated stress resistance, fin-melt resistance and core-crack resistance. While the pressing ability of the old type continuous cast-rolling machine was low since pressing of the solidified layer had not been assumed, the up-to-date continuous cast-rolling machine is able to apply a large pressing force. Therefore, the coarse crystallized materials may be finely divided by pressing immediately after solidification, even when the crystallized materials are connected and bonded as dendrites after completing solidification to form giant crystallized products.

Figure 4:
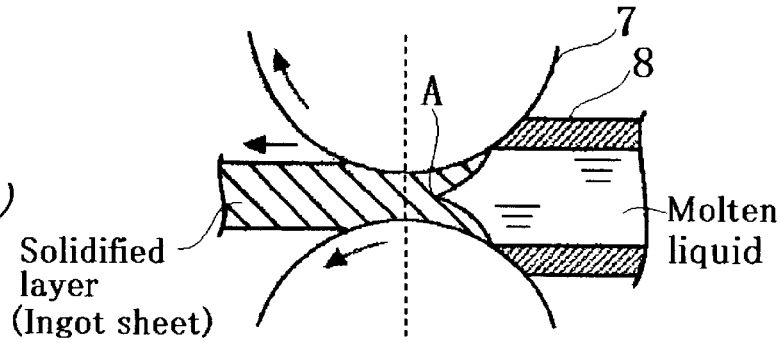
FIGS. 4(*a*), 4(*b*), and 4(*c*) are illustrative views of the state of severed coarse crystallized material in twin-roll-type continuous cast-rolling, in which FIGS. 4(*a*) and 4(*b*) are views observing the ingot sheet from its side, and FIG. 4(*c*) is a view observing from above.
Figure 4:
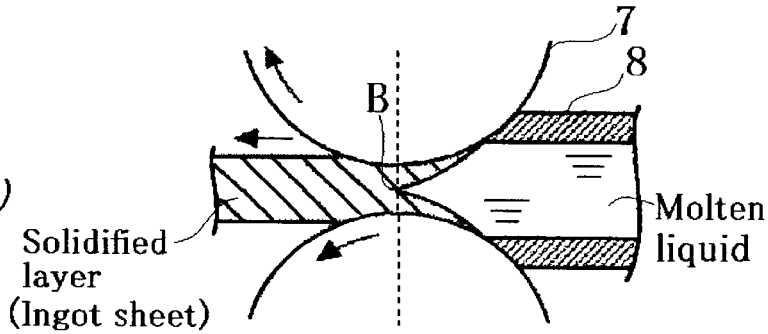
Figure 4:
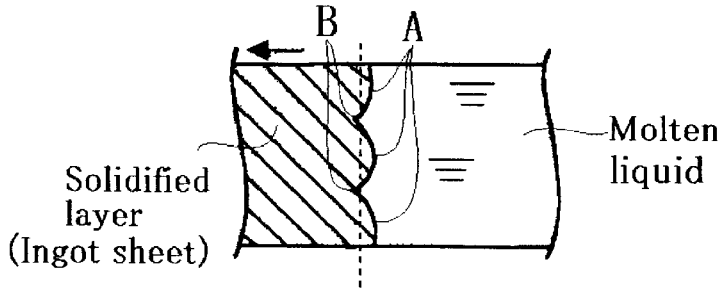

FIGS. 4(*a*), 4(*b*), and 4(*c*) schematically illustrates the state of division of the above-described coarse crystallized materials.

The above-described coarse crystallized materials are liable to be formed at final solidification parts at the center in the direction of thickness of the ingot sheet. The coarse crystallized materials may be finely divided by applying a pressure immediately after crystallization, when the final solidification part is located at a site A in front of the central line of twin rolls 7 (a line connecting the rotational axis of each rolls, represented by a dotted line), as shown in FIG. 4(*a*). On the other hand, when the final solidification part is located at a site B crossing over the central line, as shown in FIG. 4(*b*), the coarse crystallized materials formed remains in the ingot as they are without being pressurized.

FIG. 4(*c*) is a view, observing from above, of the final solidification sites A and B. The final solidification sites are crossing over the central line here and there (the state shown in FIG. 4(*c*)), and the coarse crystallized materials and Si crystallized at an early stage appear at the site B.

Troubles encountered in the above-described FIG. 4(*b*) are solved, by applying a given roll pressure load, to allow the molten liquid to contact the roll in the roll width direction in front of the central line at an even timing. The reference numeral 8 in FIG. 4 shows a molten liquid feed nozzle.

The roll pressure load is restricted in the range of 5,000 to 15,000 N/mm in the present invention, because the effect for finely dividing the coarse crystallized materials cannot be obtained at the pressure load of less than 5,000 N/mm, causing breakage of the fin material, and decrease of fin-melt resistance, mechanical strength, heat conductivity, corrosion resistance and core-crack resistance.

On the other hand, the foregoing effect is also saturated when the roll pressure load is applied at a level exceeding 15,000 N/mm. The roll pressure load of exceeding 15,000 N/mm is a level that cannot be attained by using an up-to-date continuous cast-rolling machine unless the width of the cast sheet is narrowed. However, narrowing the sheet width is not preferable since productivity thereof decreases. Accordingly, the upper limit of the roll pressure load is defined to be 15,000 N/mm in the present invention, and particularly preferable range thereof is 7,000 to 12,000 N/mm.

Figure 5:
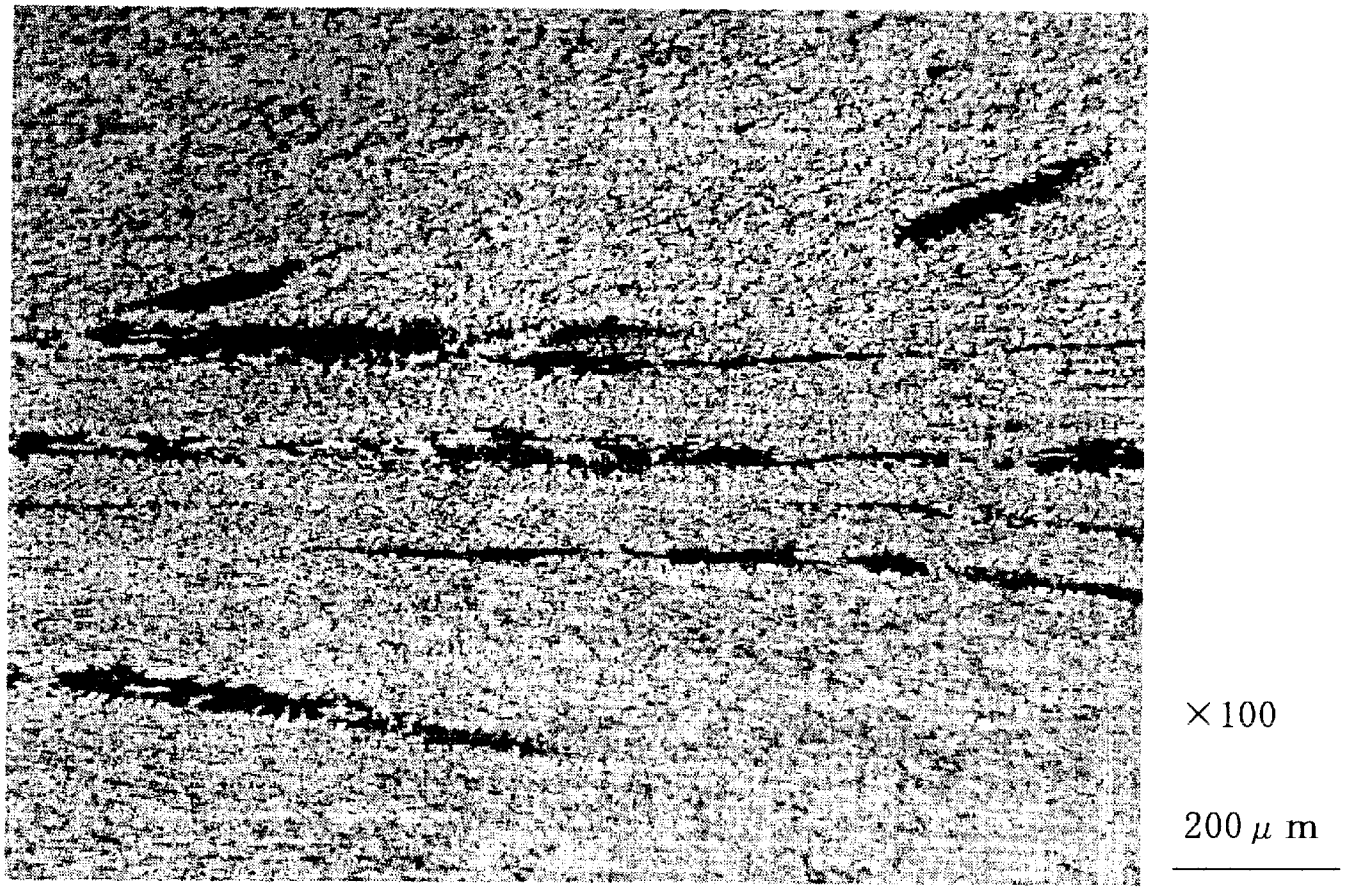
FIG. 5 is a sectional texture view of the sheet ingot prepared by continuous cast-rolling under conventional conditions.

A fin material having good characteristics can be obtained by continuous cast-rolling of the alloy having a prescribed composition as defined in the present invention, under the conditions of appropriately determined molten liquid temperature and roll pressure load. FIG. 5 shows a cross sectional texture of the ingot manufactured using a conventional twin-roll type continuous cast-rolling machine having a small roll pressure load. Coarse crystallized materials are segregated at the central portion.

The casting speed is prescribed to 500 to 3,000 mm/min in the present invention. Coarse crystallized materials appear, and the fin is broken in the assembling step of the core while decreasing repeated stress resistance, fin-melt resistance and core-crack resistance, when the casting speed is less than 500 mm/min. The higher casting speed is more preferable from the viewpoint of productivity.

A thick solidified layer cannot be formed due to insufficient cooling ability of roll, when the casting speed exceeds 3,000 mm/min, and coarse crystallized materials appear in the state as shown in FIG. 4(*b*) because a prescribed roll pressure load cannot be loaded.

The particularly preferable casting speed is in the range of 700 to 1,600 mm/min.

The thickness of the ingot sheet is defined to be 2 to 9 mm in the present invention. This is because the ingot sheet may be unable to reel up as a coil due to fluctuation of the thickness of the ingot or occurrence of waviness of the sheet, when the thickness is less than 2 mm. On the other hand, medium size crystallized materials may be formed at near the center of the sheet where the cooling speed is slow when the thickness exceeds 9 mm, thereby arising breakage of the fin during assembly of the core, and decrease of the repeated stress resistance, fin-melt resistance and core-crack resistance. Since the roll pressure load and the thickness of the ingot sheet are defined in the present invention, the thickness of the sheet is seldom varied to be thicker than the desired thickness to substantially reduce the possibility to generate coarse crystallized materials.

While the thickness of the ingot sheet is generally restricted to 2 to 9 mm in the present invention, the particularly preferably thickness of the ingot sheet is 2.5 to 7 mm, and the most preferable range thereof is 3 to 6 mm.

In the present inventions according to the items (1) to (4) as described above, the final intermediate annealing is applied in the temperature range of 300 to 450° C., and at a temperature not completing recrystallization, using a batch-type heating furnace. The batch-type heating furnace is used for final intermediate annealing in order to secure longer heating and retention time. The heating time is preferably 30 minutes or more. The upper limit may be appropriately determined, but it is preferably 4 hours or less.

Intermediate annealing midway in the cold-rolling step is applied for depositing super-saturated Fe and Mn in the solid solution during the continuous cast-rolling, or for preventing edge cracks from appearing during the cold-rolling. In particular, the final intermediate annealing is applied using the batch-type heating furnace, because Fe and Mn cannot be sufficiently deposited by continuous annealing due to short annealing time. The material may break in the final cold-rolling step due to insufficient temperature when the annealing temperature is less than 300° C., besides decreasing the mechanical strength and heat conductivity due to insufficient deposition of Fe and Mn. The precipitate are coarsened to decrease the mechanical strength at an annealing temperature of exceeding 450° C., while decreasing repeated stress resistance, fin-melt resistance and core-crack resistance. The particularly preferable temperature range is 320° C. or more and 420° C. or less.

The temperature, at which recrystallization has not been completed, refers to an annealing temperature when the recrystallized grains with a longest particle diameter of 50 μm or more occupies 30% or less in the area ratio on the surface of the sheet after annealing. Recrystallization is considered to be completed when the area ratio becomes larger than 30%. The final intermediate annealing is applied in the present invention at a temperature not completing recrystallization. The reason is as follows. Remaining dislocations are pinned by fine particles formed during the casting step, at the temperature that recrystallization has not been completed. While Fe, Mn and Si super-saturated in the solid solution during the casting step are diffused along the above-described dislocation and deposited there, Mn and Si are deposited with being absorbed in the above-described fine particles. While the intermetallic compound formed during the casting step contains a larger proportion of Fe, the compound is converted into a phase containing larger proportion of Mn and Si by such a diffusion during the annealing step. Since Mn and Si hardly form a solid-solution again during the brazing step in the phase abundant in Mn and Si, a fin material excellent in heat conductivity can be obtained, besides improving self-corrosion resistance of the fin material. Mn and Si are insufficiently diffused to decrease the heat conductivity and self-corrosion resistance, by annealing at a temperature for completing recrystallization, because the above-described dislocations disappear.

Since the specific recrystallization temperature changes depending on the composition of the alloy and thermal hysteresis before intermediate annealing, recrystallization is sometimes completed within the temperature range described above. Accordingly, the intermediate annealing conditions are practically determined to carry out, by previously confirming the temperature that does not complete recrystallization.

Although the intermediate annealing time is not particularly restricted, a time period of about 20 minutes to about 6 hours is preferable, since too short time interval makes the overall temperature of the coil to be hardly stabilized and too long time interval allows the precipitate materials to be coarsened.

Two times or more of intermediate annealing may be applied in the present invention according to the items (1) to (4), in which the purpose thereof is to improve cold-rolling ability, and the form of the deposited phase should not be changed. Therefore, when two times or more of intermediate annealing are carried out and the intermediate annealing other than the final intermediate annealing is applied using a continuous-type heating furnace, preferably the holding time is adjusted to 20 seconds or less in the annealing temperature range of 400 to 600° C. An annealing temperature range of 270 to 340° C. is preferable when the batch-type heating furnace is used.

The cold-rolling ratio after the final intermediate annealing is adjusted to 10 to 60% in the present invention according to the items (1) to (4). A rolling ratio of less than 10% is difficult to control while decreasing the droop resistance and corrugate formability. When the rolling ratio exceeds 60%, on the other hand, the recrystallization texture of the fin after brazing becomes so fine that the droop resistance and fin-melt resistance are decreased.

In the present invention according to the items (5) to (8), annealing after the final cold-rolling is applied in the temperature range of 300 to 450° C., and at a temperature not completing recrystallization, at the final thickness of the sheet, using the batch-type heating furnace.

The final annealing is applied in the temperature range described above, in order to allow super-saturated Fe and Mn in the solid solution to be deposited as hitherto described. Applying annealing after the final cold-rolling permits yield strength and elongation to be improved even when the tensile strength is in the same order, enabling the fin material to be excellent in formability, in particular in corrugate formability. Annealing at a temperature of less than 300° C. is insufficient for improving corrugate formability, or allowing Fe and Mn to be sufficiently deposited, thereby decreasing the mechanical strength and heat conductivity after brazing. A temperature of exceeding 450° C. makes coarse particles to precipitate, thereby decreasing the mechanical strength after brazing, repeated stress resistance, fin-melt resistance and core-crack resistance.

Annealing with the continuous heating furnace is not suitable for sufficiently depositing Fe and Mn since the heating time is too short.

The final cold-rolling ratio is adjusted to 10 to 95% in the present inventions according to the items (5) to (8). Either the continuous heating furnace or the batch-type heating furnace may be used for the intermediate annealing method other than the final annealing method. It is preferable when using the continuous heating furnace to adjust the temperature in the range of 400 to 600° C., so that the recrystallized crystal grain diameter as observed on the surface of the sheet becomes about 8 times or less the thickness of the sheet during annealing. The grains deposited in the final annealing step are finely dispersed with less deposition and coarsening of the intermetallic compound accompanied by annealing when the intermediate annealing is applied using the continuous heating furnace, thereby improving the corrosion resistance, breakage resistance and mechanical strength of the fin material. An annealing temperature of less than 400° C. prevents recrystallization from sufficiently advancing, to deteriorate cold-rolling ability thereafter. The annealing temperature of exceeding 600° C. also degrades corrosion resistance, because coarse grains are formed even by continuous annealing. The particularly recommended final cold-rolling ratio is 60 to 95% when the continuous annealing is applied, because the recrystallization temperature becomes lower than the melt-initiation temperature of the brazing material due to sufficient accumulation of strain to improve fin-melt resistance and the like. While the annealing time is not particularly defined, annealing is not held, or the annealing time is preferably 20 seconds or less.

On the other hand, it is preferable to adjust the temperature range within 250 to 450° C. and at a temperature not completing recrystallization, when the intermediate annealing, other than the final annealing, is applied using the batch-type heating furnace. This is because the aluminum alloy manufactured by continuous cast-rolling contains extremely small amount of second phase dispersion particles with a particle diameter of 3 to 4 μm or more as recrystallization nuclei. Accordingly, the crystal grain diameter is coarsened up to several mm or more when such a material is annealed in the batch-type heating furnace, thereby making cold-rolling thereafter to be difficult. Softening is so insufficient at an annealing temperature of less than 250° C. that the fin material has poor cold-rolling ability to occur cracks at the edge or the like. Cold-rolling ability also becomes poor at an annealing temperature of exceeding 450° C. due to coarsening of the recrystallized grains and deposited phase. Although the annealing time is not particularly defined, it is preferably 30 minutes to 4 hours. An annealing time of less than 30 minutes may make the temperature of the entire coil to be hardly stabilized, while an annealing temperature of more than 4 hours consumes too much excess energy. The recommended final cold-rolling ratio is in the range of 10 to 40% from the viewpoint of rolling ability and braze-diffusion resistance, when annealing is applied using the batch-type heating furnace.

In the present inventions according to the items (5) to (8), annealing is applied at the final thickness of the sheet using the batch-type heating furnace in order to ensure longer heating and holding time. The time period is preferably 30 minutes or more, with an appropriately determined upper limit, which is preferably 4 hours or less.

The crystal texture comprising a fibrous texture in the item (10) refers to a texture composed of those in which the crystal grain boundary is appeared to be elongated in the rolling direction during the continuous cast-rolling on the entire surface (or cross section).

The fin material manufactured according to the present invention is subjected to brazing as mentioned above. The term "brazing" is referred to as a conventional brazing method, such as a nocolock brazing (CAB method) and vacuum brazing, and it is not particularly restricted. The nocolock brazing method is particularly recommended from the viewpoint of productivity.

According to the present invention, the aluminum alloy fin material for brazing, which sufficiently satisfies the characteristics required for a fin material (such as mechanical strength, heat conductivity, electrical conductivity, sacrificial corrosion preventive effect, self-corrosion resistance, repeated stress resistance, fin-melt resistance, droop resistance, core-crack resistance, rolling ability, fin-break resistance and corrugate formability), and which is capable of being thinned, can be manufactured.

The amount of Si and Mn involved in the crystallized materials becomes small in the conventionally used DC casting method, due to slow cooling speed during the casting step; in addition, the crystallized materials are coarsened with a small number of them. Accordingly, most of the elements in the solid solution such as Fe, Si and Mn are deposited in the matrix, not on the crystallized phase during the annealing step. The deposited phase in the matrix is a compound that is mainly comprised of Si and Mn, and Fe is involved in the crystalline phase in a large proportion. The intermetallic compound comprised of Si and Mn readily forms a solid solution again during the brazing step, thereby decreasing heat conductivity after brazing. Furthermore, the mechanical strength improving effect, due to enhanced dispersion of the crystallized materials, is small in the conventional DC casting method, because the crystallized materials are coarsened. The self-corrosion resistance of the fin material also decreases, due to a large proportion of Fe in the crystalline phase.

A large amount of Mn, Fe and Si are allowed to finely crystallize or deposit in the present invention, while controlling the kind of the deposited crystalline phase, by manufacturing the Al—Mn—Fe—Si-series alloy having a prescribed composition by a prescribed manufacturing process. Consequently, the intermetallic compound hardly forms a solid solution again during the brazing step. Further, the characteristics required for thinning the fin material, such as the tensile strength after brazing, heat conductivity, self-corrosion resistance, fin-melt resistance, core-crack resistance, fin-breakage resistance and corrugate formability, are improved, in the fin material for brazing obtained according to the present invention. Accordingly, thinning of the fin material is possible according to the present invention, to exhibit industrially remarkable effects.

EXAMPLE

The present invention will be explained in more detail referring to the following examples, but the invention is not limited thereto.

Example 1

The Al alloy having the composition, as shown in Table 1, defined in the present invention, was melted, and the molten liquid obtained was cast into an ingot sheet with a width of 1000 mm by the continuous cast-rolling method using a twin roller with a roll diameter of 880 mm. The ingot sheet was reeled into a coil, and then it was subjected to cold-rolling, to manufacture a fin material.

In continuous cast-rolling method, the manufacturing conditions, such as the molten liquid temperature, the roll pressure load, the casting speed, the thickness of the ingot sheet; the number, temperature and time period of intermediate annealing midway in the cold-rolling step; the final cold-rolling ratio, and the thickness of the fin material, were variously changed within the conditions as defined in the present invention, as shown in Tables 2 and 3.

Comparative Example 1

The fin material was manufactured by the same method as in Example 1, except that the Al alloy whose composition was outside the definition in the present invention, as shown in Table 1, was used. The manufacturing conditions are shown in Table 4.

Comparative Example 2

The fin material was manufactured by the same method as in Example 1, except that the manufacturing conditions in the continuous cast-rolling and cold-rolling steps were outside the definition in the present invention, as shown in Table 5.

Comparative Example 3

The Al alloy with the composition defined in the present invention, as shown in Table 1, was melted, the molten liquid obtained was cast into a slab with a thickness of 400 nm by the DC casting method, followed by reeling into a coil after hot rolling, and the hot-roll sheet was finally cold-rolled into a fin material (see the experiment No. 29 in Table 5).

The final batch annealing was applied at a temperature not completing recrystallization, except for the experiment Nos. 37 and 39.

Crystal textures were investigated and droop resistance was evaluated in the fin materials manufactured in Example 1 and Comparative examples 1 to 3.

The crystal texture was observed and examined under an optical microscope.

Droop resistance was evaluated, by measuring the droop length (mm) after heating, by horizontally holding the fin material so that the projection length would be 50 mm followed by heating at 600° C. for 10 minutes.

Further, the tensile strength and electrical conductivity were measured after heating the fin material at a condition corresponding to a brazing condition (600° C.×4 minutes), followed by evaluation of repeated stress resistance and self-corrosion resistance.

The tensile strength was measured in accordance with JIS Z 2241, and electrical conductivity was measured in accordance with JIS H 0505.

The repeated stress resistance was evaluated, by measuring by counting the repeat number before break of a test piece, wherein a sample with a width of 16 mm and a length of 50 mm was cut from the fin material after the above heating, and a tensile stress of 5 kgf/mm$^2$ was applied at a frequency of 10 Hz.

For evaluating the self-corrosion resistance, the weight loss of the sample by corrosion was examined after 7 days' CASS test.

Further, the fin material after the cold-rolling was cut into slits with a width of 16 mm. The slit sample was formed into a corrugate shape, followed by assembling onto a tube material with a length of 100 mm, and 5 step or 10 step mini-cores were manufactured by brazing. Fin-melt resistance of the five-step mini-core was evaluated by micro-observation, while core-crack resistance of the 10-step mini-core was evaluated by observation with the naked eye.

The research and evaluation results are shown in Table 6. Breakage of the fin, if any, during assembly to the mini-core was also listed in Table 6. The residue of the alloy broken during the cold-rolling step was cold-rolled in the laboratory to form a fin material, and the resultant fin material was investigated or evaluated.

TABLE 1

| | Alloy No. | Mn | Fe | Si | Zn | In | Sn | Cu | Cr | V | Ti | Zr | Mg | Al |
|---|---|---|---|---|---|---|---|---|---|---|---|---|---|---|
| Example of this invention | A | 0.8 | 1.6 | 0.9 | 0.5 | — | — | — | — | — | — | — | — | Balance |
| | B | 1.4 | 1.5 | 0.95 | — | — | — | — | — | — | — | — | — | Balance |
| | C | 1.2 | 1.8 | 1.0 | 0.2 | — | — | — | — | — | — | — | — | Balance |
| | D | 1.0 | 1.3 | 0.8 | 1.5 | — | — | — | — | — | — | — | — | Balance |
| | E | 0.9 | 1.7 | 0.75 | 0.5 | 0.01 | 0.01 | — | — | — | — | — | — | Balance |
| | F | 0.8 | 1.6 | 0.95 | 0.8 | — | — | — | — | — | — | — | — | Balance |
| | G | 1.3 | 1.4 | 0.75 | 1.0 | 0.01 | — | 0.05 | — | — | — | — | — | Balance |
| | H | 0.7 | 1.6 | 0.9 | — | — | — | — | 0.10 | 0.08 | 0.02 | — | 0.04 | Balance |
| | I | 1.0 | 1.7 | 1.0 | 2.0 | — | — | 0.18 | — | — | — | — | — | Balance |
| | J | 0.9 | 1.5 | 0.8 | 0.6 | — | — | — | — | — | — | 0.05 | — | Balance |
| Comparative example | K | 1.9 | 1.5 | 0.8 | — | — | — | — | — | — | — | — | — | Balance |
| | L | 0.5 | 1.5 | 0.7 | — | — | — | — | — | — | — | — | — | Balance |
| | M | 0.9 | 2.2 | 0.9 | — | — | — | — | — | — | — | — | — | Balance |
| | N | 1.1 | 1.2 | 0.8 | — | — | — | — | — | — | — | — | — | Balance |
| | O | 1.0 | 1.6 | 1.3 | — | — | — | — | — | — | — | — | — | Balance |
| | P | 1.2 | 1.5 | 0.5 | — | — | — | — | — | — | — | — | — | Balance |
| | Q | 1.0 | 1.6 | — | — | — | — | — | — | — | — | — | — | Balance |

Note: The data underlined are outside the definition of the present invention. Unit, mass %

TABLE 2

| | Experiment No. | Alloy No. | Molten liquid temperature (° C.) | Roll load (N/mm) | Casting speed (mm/min) | Thickness of ingot sheet (mm) | Cold-rolling step |
|---|---|---|---|---|---|---|---|
| Example of this invention | 1 | A | 780 | 10000 | 1200 | 4 | Cold-rolling to 0.8 mm → Batch annealing at 300° C. × 2 h → Cold-rolling to 0.07 mm → Batch annealing at 420° C. × 2 h → Cold-rolling to 0.06 mm |
| | 2 | A | 810 | 12000 | 1600 | 3 | Cold-rolling to 0.9 mm → Continuous annealing at 500° C. × 10 s → Cold-rolling to 0.08 mm → Batch annealing at 380° C. × 3 h → Cold-rolling to 0.06 mm |
| | 3 | B | 760 | 9000 | 840 | 5.5 | Cold-rolling to 0.8 mm → Batch annealing at 300° C. × 3 h → Cold-rolling to 0.075 mm → Batch annealing at 400° C. × 2 h → Cold-rolling to 0.06 mm |
| | 4 | B | 830 | 8000 | 800 | 6 | Cold-rolling to 2 mm → Batch annealing at 280° C. × 3 h Cold-rolling to 0.7 mm → Batch annealing at 300° C. × 2 h → Cold-rolling to 0.08 mm → Batch annealing at 420° C. × 2 h → Cold-rolling to 0.06 mm |
| | 5 | C | 790 | 12000 | 770 | 5.5 | Cold-rolling to 0.5 mm → Continuous annealing at 520° C. × 0 s → Cold-rolling to 0.07 mm → Batch annealing at |

TABLE 2-continued

| | Experiment No. | Alloy No. | Molten liquid temperature (° C.) | Roll load (N/mm) | Casting speed (mm/min) | Thickness of ingot sheet (mm) | Cold-rolling step |
|---|---|---|---|---|---|---|---|
| | | | | | | | 360° C. × 5 h → Cold-rolling to 0.06 mm |
| | 6 | C | 790 | 12000 | 770 | 5.5 | Cold-rolling to 2.4 mm → Batch annealing at 330° C. × 1.5 h → Cold-rolling to 0.1 mm → Batch annealing at 420° C. × 2 h → Cold-rolling to 0.06 mm |
| | 7 | D | 820 | 10000 | 1200 | 4 | Cold-rolling to 0.6 mm → Continuous annealing at 570° C. × 0 s → Cold-rolling to 0.07 mm → Batch annealing at 400° C. × 3 h → Cold-rolling 0.06 mm |
| | 8 | D | 780 | 12000 | 1600 | 3 | Batch annealing at 300° C. × 2 h → Cold-rolling to 0.6 mm → Continuous annealing at 550° C. × 10 s → Cold-rolling to 0.1 mm → Batch annealing at 330° C. × 5 h → Cold-rolling to 0.06 mm |
| | 9 | E | 850 | 9000 | 840 | 5.5 | Batch annealing at 300° C. × 2 h → Cold-rolling to 0.6 mm → Batch annealing at 330° C. × 2 h → Cold-rolling to 0.08 mm → Batch annealing at 370° C. × 2 h → Cold-rolling to 0.06 mm |
| | 10 | E | 840 | 7200 | 900 | 3.6 | Batch annealing at 270° C. × 3 h → Cold-rolling to 0.9 mm → Continuous annealing at 500° C. × 0 d → Cold-rolling to 0.09 mm → Batch annealing at 350° C. × 3.5 h → Cold-rolling to 0.06 mm |

Note: Zero second in annealing treatment means that the ingot sheet is not maintained at the objective temperature after reaching at the temperature.

TABLE 3

| | Experiment No. | Alloy No. | Molten liquid temperature (° C.) | Roll load (N/mm) | Casting Speed (mm/min) | Thickness of ingot sheet (mm) | Cold-rolling step |
|---|---|---|---|---|---|---|---|
| Example of this invention | 11 | F | 770 | 10000 | 1200 | 5.5 | Batch annealing at 270° C. × 3 h → Cold-rolling to 0.85 mm → Batch annealing at 290° C. × 2 h → Cold-rolling to 0.07 mm → Batch annealing at 360° C. × 5 h → Cold-rolling to 0.06 mm |
| | 12 | F | 750 | 8000 | 1500 | 4.4 | Cold-rolling to 0.7 mm → Continuous annealing at 530° C. × 10 s → Cold-rolling to 0.06 mm → Batch annealing at 390° C. × 2 h |
| | 13 | G | 840 | 7000 | 1600 | 6 | Cold-rolling to 0.4 mm → Continuous annealing at 480° C. × 0 s → Cold-rolling to 0.06 mm → Batch annealing at 360° C. × 3 h |
| | 14 | G | 800 | 12000 | 1000 | 3 | Cold-rolling to 0.1 mm → Batch annealing at 340° C. × 1.5 h → Cold-rolling to 0.06 mm → Batch annealing at 390° C. × 2 h |
| | 15 | H | 770 | 11000 | 1100 | 3.8 | Cold-rolling to 0.8 mm → Batch annealing at 270° C. × 5 h → Cold-rolling to 0.06 mm → Batch annealing at 420° C. × 1 h |
| | 16 | H | 820 | 9600 | 1300 | 4.4 | Cold-rolling to 0.5 mm → Continuous annealing at |

TABLE 3-continued

| Experiment No. | Alloy No. | Molten liquid temperature (° C.) | Roll load (N/mm) | Casting Speed (mm/min) | Thickness of ingot sheet (mm) | Cold-rolling step |
|---|---|---|---|---|---|---|
| | | | | | | 570° C. × 0 s → Cold-rolling to 0.06 mm → Batch annealing at 400° C. × 2 h |
| 17 | I | 760 | 10000 | 840 | 6 | Cold-rolling to 0.9 mm → Batch annealing at 330° C. × 3 h → Cold-rolling to 0.075 mm → Batch annealing at 330° C. × 3 h → Cold-rolling to 0.06 mm → Batch annealing at 330° C. × 3 h |
| 18 | I | 790 | 11500 | 960 | 5.5 | Cold-rolling to 0.8 mm → Batch annealing at 290° C. × 2 h → Cold-rolling to 0.3 mm → Continuous annealing at 500° C. × 0 s → Cold-rolling to 0.06 mm → Batch annealing at 380° C. × 3 h |
| 19 | J | 830 | 7200 | 1200 | 3.2 | Cold-rolling to 0.9 mm → Continuous annealing at 500° C. × 10 s → Cold-rolling to 0.08 mm → Batch annealing at 380° C. × 3 h → Cold-rolling to 0.06 mm → Batch annealing at 340° C. × 2 h |
| 20 | J | 810 | 9600 | 1500 | 4.4 | Cold-rolling to 0.7 mm → Batch annealing at 320° C. × 2 h → Cold-rolling to 0.1 mm → Batch annealing at 280° C. × 3 h → Cold-rolling to 0.06 mm → Batch annealing at 360° C. × 2 h |

TABLE 4

| | Experiment No. | Alloy No. | Molten liquid temperature (° C.) | Roll load (N/mm) | Casting speed (mm/min) | Thickness of ingot sheet (mm) | Cold-rolling step |
|---|---|---|---|---|---|---|---|
| Comparative example | 21 | K | 780 | 10000 | 1400 | 4 | Cold-rolling to 0.8 mm → Batch annealing at 320° C. × 3 h → Cold-rolling to 0.07 mm → Batch annealing at 400° C. × 2 h → Cold-rolling to 0.06 mm |
| | 22 | L | 780 | 10000 | 1200 | 4 | Cold-rolling to 0.8 mm → Batch annealing at 320° C. × 3 h → Cold-rolling to 0.07 mm → Batch annealing at 400° C. × 2 h → Cold-rolling to 0.06 mm |
| | 23 | L | 780 | 4500 | 1200 | 4 | Cold-rolling to 0.9 mm → Batch annealing at 320° C. × 3 h → Cold-rolling to 0.12 mm → Batch annealing at 400° C. × 2 h → Cold-rolling to 0.06 mm |
| | 24 | M | 780 | 10000 | 1200 | 4 | Cold-rolling to 0.1 mm → Batch annealing at 340° C. × 1.5 h → Cold-rolling to 0.06 mm → Batch annealing at 390° C. × 2 h |
| | 25 | N | 780 | 10000 | 1200 | 4 | Cold-rolling to 0.1 mm → Batch annealing at 340° C. × 1.5 h → Cold-rolling to 0.06 mm → Batch annealing at 390° C. × 2 h |
| | 26 | O | 780 | 10000 | 1200 | 4 | Cold-rolling to 0.9 mm → Continuous annealing at 500° C. × 10 s → Cold-rolling to 0.08 mm → Batch annealing at 380° C. × 3 h → Cold-rolling to 0.06 mm |
| | 27 | P | 780 | 10000 | 1200 | 4 | Cold-rolling to 0.9 mm → Continuous annealing at 500° C. × 10 s → Cold- |

TABLE 4-continued

| | Experiment No. | Alloy No. | Molten liquid temperature (° C.) | Roll load (N/mm) | Casting speed (mm/min) | Thickness of ingot sheet (mm) | Cold-rolling step |
|---|---|---|---|---|---|---|---|
| | | | | | | | rolling to 0.08 mm → Batch annealing at 380° C. × 3 h → Cold-rolling to 0.06 mm |
| | 28 | Q | 780 | 10000 | 1200 | 4 | Cold-rolling to 0.4 mm → Continuous annealing at 480° C. × 0 s → Cold-rolling to 0.06 mm → Batch annealing at 360° C. × 3 h |

Nos. 21 to 28: Comparative example 1

TABLE 5

| | Experiment No. | Alloy No. | Molten liquid temperature (° C.) | Roll load (N/mm) | Casting speed (mm/min) | Thickness of ingot sheet (mm) | Cold-rolling step |
|---|---|---|---|---|---|---|---|
| Comparative example | 29 | A | 780 | Manufacture of ingot having 400 mm of thickness by DC casting → Scalping → Manufacture of coil having 5 mm of thickness by hot rolling | | | Cold-rolling to 0.8 mm → Batch annealing at 320° C. × 3 h → Cold-rolling to 0.07 mm → Batch annealing at 400° C. × 2 h → Cold-rolling to 0.06 mm |
| | 30 | A | 680 | 13000 | 1500 | 5 | Cold-rolling to 0.8 mm → Batch annealing at 320° C. × 3 h → Cold-rolling to 0.07 mm → Batch annealing at 400° C. × 2 h → Cold-rolling to 0.06 mm |
| | 31 | A | 920 | 9000 | 1000 | 4 | Cold-rolling to 0.8 mm → Batch annealing at 320° C. × 3 h → Cold-rolling to 0.07 mm → Batch annealing at 400° C. × 2 h → Cold-rolling to 0.06 mm |
| | 32 | B | 780 | 4000 | 1200 | 5.5 | Cold-rolling to 0.8 mm → Batch annealing at 320° C. × 3 h → Cold-rolling to 0.07 mm → Batch annealing at 400° C. × 2 h → Cold-rolling to 0.06 mm |
| | 33 | B | 780 | 12000 | 450 | 4 | Cold-rolling to 0.8 mm → Batch annealing at 320° C. × 3 h → Cold-rolling to 0.07 mm → Batch annealing at 400° C. × 2 h → Cold-rolling to 0.06 mm |
| | 34 | C | 780 | 4500 | 3100 | — | Note: Coil could not be manufactured since the molten liquid did not be solidified |
| | 35 | C | 780 | 8000 | 1200 | 10 | Cold-rolling to 0.08 mm → Batch annealing at 320° C. × 3 h → Cold-rolling to 0.07 mm → Batch annealing at 400° C. × 2 h → Cold-rolling to 0.06 mm |
| | 36 | D | 790 | 13000 | 1000 | 4 | Cold-rolling to 0.08 mm → Batch annealing at 320° C. × 3 h → Cold-rolling to 0.07 mm → Batch annealing at 280° C. × 5 h → Cold-rolling to 0.06 mm |
| | 37 | D | 820 | 10000 | 770 | 3 | Cold-rolling to 0.08 mm → Batch annealing at 320° C. × 3 h → Cold-rolling to 0.07 mm → Batch annealing at 470° C. × 2 h → Cold-rolling to 0.06 mm |
| | 38 | E | 800 | 14000 | 1200 | 3 | Cold-rolling to 0.08 mm → Batch annealing at 320° C. × 4 h → Cold-rolling to 0.17 mm → Batch annealing at 420° C. × 2 h → Cold-rolling to 0.06 mm |
| | 39 | F | 790 | 8000 | 900 | 4 | Cold-rolling to 0.1 mm → Batch annealing at 360° C. × 3 h → Cold-rolling to 0.06 mm |

TABLE 5-continued

| Experiment No. | Alloy No. | Molten liquid temperature (° C.) | Roll load (N/mm) | Casting speed (mm/min) | Thickness of ingot sheet (mm) | Cold-rolling step |
|---|---|---|---|---|---|---|
| | | | | | | → Batch annealing at 470° C. × 2 h |

No. 29: Comparative example 3, Nos. 30 to 39: Comparative example 2

TABLE 6

| | | | | | After brazing and heating | | | | | |
|---|---|---|---|---|---|---|---|---|---|---|
| Experiment No. | Results of casting and rolling | Fin texture | Breakage of fin | Length of droop (mm) | Tensile strength (kgf/mm$^2$) | Number of stress just before breakage | Electrical conductivity (% IACS) | Proportion of decrease of corrosion after CASS test (%) | Melt of fin | Crack of core |
| 1 | ○[3)] | fiber[2)] | Absent | 7 | 13.2 | $3 \times 10^7$ | 51 | 4 | Absent | Absent |
| 2 | ○ | fiber | Absent | 5 | 13.9 | $2 \times 10^7$ | 49 | 3 | Absent | Absent |
| 3 | ○ | fiber | Absent | 6 | 13.7 | $3 \times 10^7$ | 51 | 5 | Absent | Absent |
| 4 | ○ | fiber | Absent | 8 | 13.5 | $2 \times 10^7$ | 50 | 6 | Absent | Absent |
| 5 | ○ | fiber | Absent | 5 | 13.0 | $3 \times 10^7$ | 52 | 6 | Absent | Absent |
| 6 | ○ | fiber | Absent | 7 | 13.1 | $3 \times 10^7$ | 53 | 5 | Absent | Absent |
| 7 | ○ | fiber | Absent | 6 | 13.3 | $2 \times 10^7$ | 51 | 5 | Absent | Absent |
| 8 | ○ | fiber | Absent | 4 | 13.7 | $3 \times 10^7$ | 49 | 4 | Absent | Absent |
| 9 | ○ | fiber | Absent | 5 | 13.8 | $2 \times 10^7$ | 51 | 7 | Absent | Absent |
| 10 | ○ | fiber | Absent | 6 | 13.6 | $2 \times 10^7$ | 50 | 6 | Absent | Absent |
| 11 | ○ | fiber | Absent | 8 | 13.2 | $3 \times 10^7$ | 52 | 4 | Absent | Absent |
| 12 | ○ | fiber | Absent | 6 | 13.1 | $2 \times 10^7$ | 53 | 5 | Absent | Absent |
| 13 | ○ | fiber | Absent | 7 | 13.2 | $3 \times 10^7$ | 51 | 6 | Absent | Absent |
| 14 | ○ | fiber | Absent | 7 | 13.5 | $2 \times 10^7$ | 49 | 6 | Absent | Absent |
| 15 | ○ | fiber | Absent | 6 | 13.9 | $2 \times 10^7$ | 50 | 4 | Absent | Absent |
| 16 | ○ | fiber | Absent | 4 | 13.7 | $3 \times 10^7$ | 50 | 5 | Absent | Absent |
| 17 | ○ | fiber | Absent | 5 | 13.4 | $2 \times 10^7$ | 52 | 6 | Absent | Absent |
| 18 | ○ | fiber | Absent | 4 | 13.1 | $2 \times 10^7$ | 50 | 4 | Absent | Absent |
| 19 | ○ | fiber | Absent | 6 | 13.6 | $2 \times 10^7$ | 53 | 5 | Absent | Absent |
| 20 | ○ | fiber | Absent | 5 | 13.5 | $3 \times 10^7$ | 51 | 5 | Absent | Absent |
| 21 | ○ | fiber | Absent | 7 | 13.8 | $2 \times 10^7$ | 41 | 15 | Absent | Absent |
| 22 | ○ | fiber | Absent | 6 | 12.1 | $7 \times 10^6$ | 50 | 14 | Absent | Absent |
| 23 | ○ | fiber | Present | 14 | 11.4 | $8 \times 10^6$ | 49 | 10 | Present | Present |
| 24 | Breakage during the rolling step[1)] | fiber | Present | 15 | 13.4 | $2 \times 10^7$ | 48 | 18 | Present | Absent |
| 25 | ○ | fiber | Absent | 6 | 12.0 | $7 \times 10^6$ | 42 | 7 | Absent | Absent |
| 26 | Breakage during the rolling step | fiber | Present | 5 | 13.1 | $6 \times 10^6$ | 44 | 6 | Present | Absent |
| 27 | ○ | Recrystal-lization | Present | 9 | 11.9 | $9 \times 10^6$ | 40 | 10 | Present | Present |
| 28 | ○ | Recrystal-lization | Present | 18 | 11.2 | $6 \times 10^6$ | 38 | 17 | Present | Present |
| 29 | ○ | fiber | Present | 15 | 11.0 | $7 \times 10^6$ | 39 | 18 | Present | Present |
| 30 | Breakage during the rolling step | fiber | Present | 17 | 14.0 | $8 \times 10^6$ | 48 | 8 | Present | Present |
| 31 | Breakage during the rolling step | fiber | Present | 13 | 12.0 | $7 \times 10^6$ | 42 | 16 | Present | Present |
| 32 | ○ | fiber | Present | 7 | 13.4 | $7 \times 10^6$ | 47 | 6 | Present | Present |
| 33 | ○ | fiber | Present | 8 | 13.7 | $8 \times 10^6$ | 48 | 8 | Present | Present |
| 34 | Not solidified | — | — | — | — | — | — | — | — | — |
| 35 | ○ | fiber | Present | 6 | 13.3 | $8 \times 10^6$ | 50 | 7 | Present | Present |
| 36 | Breakage during the | fiber | Absent | 7 | 11.8 | $7 \times 10^6$ | 48 | 13 | Present | Present |

TABLE 6-continued

| Experiment No. | Results of casting and rolling | Fin texture | Breakage of fin | Length of droop (mm) | After brazing and heating: Tensile strength (kgf/mm$^2$) | Number of stress just before breakage | Electrical conductivity (% IACS) | Proportion of decrease of corrosion after CASS test (%) | Melt of fin | Crack of core |
|---|---|---|---|---|---|---|---|---|---|---|
| | rolling step | | | | | | | | | |
| 37 | ○ | Recrystal-lization | Present | 8 | 11.4 | $6 \times 10^6$ | 42 | 18 | Present | Present |
| 38 | Breakage during the rolling step | fiber | Present | 16 | 13.9 | $3 \times 10^7$ | 48 | 5 | Present | Absent |
| 39 | ○ | Recrystal-lization | Present | 9 | 11.4 | $6 \times 10^6$ | 42 | 18 | Present | Present |

Note:
1)Underlines show poor characteristics
2)"fiber" means the crystal texture comprising fibrous texture
3)Showing no cracks at the edge and no breakage in the longitudinal direction As is apparent from Table 6, each of the samples in the experiment Nos. 1 to 20 of the examples according to the present invention were not broken during the cold-rolling step, and the fin materials with a thickness of 0.1 mm or less could be manufactured. Further, fine crystallized materials or deposited materials were dispersed to form the fibrous texture, thereby the fin materials were excellent in droop resistance, tensile strength, electrical conductivity (heat conductivity), repeated stress resistance (the number of repeated stress just before breakage) and self-corrosion resistance (reduced proportion of corrosion), without arising fin-melting and core cracks, as well as without breakage of the fin in the forming of a corrugate for manufacturing the mini-core.

On the other hand, among the comparative examples, the sample in the experiment No. 21 was poor in the electrical conductivity and self-corrosion resistance due to a too large content of Mn.

The sample in the experiment No. 22 was poor in the tensile strength and repeated stress resistance due to a too small content of Mn. Further, a large quantity of the Al—Fe compound was formed, thereby resulting in poor self-corrosion resistance. Further, Si could not be sufficiently trapped due to the too small content of Mn, with a little decrease of the fin-melt resistance.

Medium size particles were formed, and the fin was broken during the assembling process of the core, in the sample in the experiment No. 23, since the Mn content was too small besides too low roll pressure load, thereby showing poor repeated stress resistance and core-crack resistance with a little inferior self-corrosion resistance. Further, droop resistance and fin-melt resistance were also poor, due to the presence of fine recrystallization textures.

In the sample in the experiment No. 24, since the Fe content was too large to cause crystallization of the Fe compound as the primary crystallization, thereby the fin material was broken during the cast-rolling and cold-rolling steps, and the resultant fin was broken during the core assembly step. Further, since crystallins were so fine, droop resistance was poor, and self-corrosion resistance and fin-melt resistance were also poor.

The tensile strength, repeated stress resistance, and electrical conductivity were poor in the sample in the experiment No. 25, since the deposited amount of Fe-series deposition was decreased due to the too small content of Fe.

The melting point was lowered, and Si was crystallized at an early stage to result in poor fin-melt resistance in the sample in the experiment No. 26 due to a too large content of Si. Further, primary crystallization of Si caused breakage of the fin material during the cast-rolling and cold-rolling steps, and the fin was broken in the core assembly process, with resulting poor repeated stress resistance, electrical conductivity, and fin-melt resistance.

Grains were coarsened in the sample in the experiment No. 27, due to a too small content of Si. Consequently, recrystallization texture appeared after brazing by the lowered recrystallization temperature. Resultantly, the fin was broken during the core assembly step, in addition the tensile strength and electrical conductivity, as well as repeated stress resistance, fin-melt resistance and core-crack resistance, were each poor.

Characteristics of the fin material of the experiment No. 28 were further deteriorated than those of experiment No. 27, since the fin material in No. 28 did not contain Si; and droop resistance and self-corrosion resistance were also poor.

A small amount of grains were deposited with coarsened crystallized materials in the sample in the experiment No. 29 as a result of casting by the DC method. Further, the fin was broken during the core assembly process, and droop resistance, tensile strength, repeated stress resistance, electrical conductivity, self-corrosion resistance, fin-melt resistance and core-crack resistance were poor.

The crystal grain was coarsened in the sample in the experiment No. 30 due to a too low molten liquid temperature. Consequently, the fin material was broken during the cast-rolling and cold-rolling steps, and the fin was broken during the core-assembly step; and further, poor droop resistance, repeated stress resistance, fin-melt resistance and core-crack resistance were poor.

The crystallized materials were coarsened due to a too high molten liquid temperature in the sample in the experiment No. 31. Further, the amount of precipitation was reduced due to primary crystallization of Si. As a result of these, such problems were arisen that breakage of the material during the cast-rolling and cold-rolling steps and breakage of the fin during the core assembly step, and that droop resistance, repeated stress resistance, fin-melt resistance and core-crack resistance were poor.

Medium size particles appeared in the samples in the experiment Nos. 32, 33 and 35, because the roll pressure load was too low in the experiment No. 32, the casting speed was too slow in the experiment No. 33 and the ingot was too thick in the experiment No. 35. Consequently, the fin was broken during the core assembly process, and repeated stress resistance, fin-melt resistance and core-crack resistance were poor.

The ingot sheet could not be obtained in the sample in the experiment No. 34, since the molten liquid did not solidify due to the too rapid casting speed (the roll pressure load was the low).

Annealing was insufficient to arise breakage of the material during the cold-rolling step in the sample in the experiment No. 36, since the second intermediate annealing (final intermediate annealing) temperature midway in the cold-rolling step was too low. Furhter, the tensile strength, electrical conductivity, and repeated stress resistance were poor, due to decrease of the amount of precipitation. In addition, deposition was occurred at the recrystallization grain boundaries during heating for brazing, thereby resulting poor self-corrosion resistance.

Recrystallization textures appeared by coarsening of the precipitate in the samples in the experiment Nos. 37 and 39, since the temperatures at the second intermediate annealing (final intermediate annealing) or the final annealing were too high. Consequently, the fin was broken in the core assembly process, and tensile strength, repeated stress resistance, self-corrosion resistance, fin-melt resistance and core-crack resistance were poor.

The material was broken during the cold-rolling step in the sample in the experiment No. 38, since the final roll ratio was too high in the cold-rolling step. Further, the fin material obtained was a hard material, to arise breakage of the fin during the core assembly process, while resulting poor droop resistance due to the low recrystallization temperature, since the distortion energy as driving force of recrystallization was large. Further, the fin-melt resistance was also poor due to fine recrystallization grains.

INDUSTRIAL APPLICABILITY

A fin material for brazing, which has improved characteristics necessary for thinning the fin material, such as tensile strength after brazing, heat conductivity, self-corrosion resistance, fin-melt resistance, core-crack resistance, fin-breakage resistance, and corrugate formability, can be obtained, according to the manufacturing method of to the present invention. Accordingly, the present invention is a method preferable for thinning the fin material in response to the requirements for making a heat exchanger to be small-size and light-weight.

Having described our invention as related to the present embodiments, it is our intention that the invention not be limited by any of the details of the description, unless otherwise specified, but rather be construed broadly within its spirit and scope as set out in the accompanying claims.

What is claimed is:

1. A method for manufacturing an aluminum alloy fin material for brazing, comprising the steps of:

forming an ingot sheet, by casting a molten liquid of an aluminum alloy by a twin-roll continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, with the balance being Al and inevitable impurities, wherein said twin-roll continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, and wherein two times or more of intermediate annealing are applied midway in said cold-rolling process, with said intermediate annealing including final intermediate annealing with a batch heating furnace, in a temperature range of 300 to 450° C., and at a temperature that does not allow recrystallization to complete, thereby adjusting the rolling ratio in the cold-rolling, after the final intermediate annealing, to 10 to 60%.

2. The method for manufacturing an aluminum alloy fin material for brazing as claimed in claim 1, wherein said intermediate annealing, except for the final annealing, is applied using a heating furnace.

3. An aluminum alloy fin material for brazing, wherein the crystalline texture of the fin material, which is obtained by the manufacturing method as claimed in claim 1, comprises a fibrous texture.

4. A method for manufacturing an aluminum alloy fin material for brazing, comprising the steps of:

forming an ingot sheet, by casting a molten liquid of an aluminum alloy by a twin-roll continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, as well as at least one of Zn of 3.0% by mass or less, In of 0.3% by mass or less, and Sn of 0.3% by mass or less, with the balance being Al and inevitable impurities, wherein said twin-roll continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, and wherein two times or more of intermediate annealing are applied midway in said cold-rolling process, with said intermediate annealing including final intermediate annealing with a batch heating furnace, in a temperature range of 300 to 450° C., and at a temperature that does not allow recrystallization to complete, thereby adjusting the rolling ratio in the cold-rolling, after the final intermediate annealing, to 10 to 60%.

5. The method for manufacturing an aluminum alloy fin material for brazing as claimed in claim 4, wherein said intermediate annealing, except for the final annealing, is applied using a heating furnace.

6. An aluminum alloy fin material for brazing, wherein the crystalline texture of the fin material, which is obtained by the manufacturing method as claimed in claim 4, comprises a fibrous texture.

7. A method for manufacturing an aluminum alloy fin material for brazing, comprising the steps of:

forming an ingot sheet, by casting a molten liquid of an aluminum alloy by a twin-roll continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, as well as at least one of Cu of 0.3% by mass or less, Cr of 0.15% by mass or less, Ti of 0.15% by mass or less, Zr of 0.15% by mass or less, and Mg of 0.5% by mass or less, with the balance being Al and inevitable impurities, wherein said twin-roll continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, and wherein two times or more of intermediate annealing are applied midway in said cold-rolling process, with said intermediate annealing including final intermediate annealing with a batch heating furnace, in a temperature range of 300 to 450° C., and at a temperature that does not allow recrystallization to complete, thereby adjusting the rolling ratio in the cold-rolling, after the final intermediate annealing, to 10 to 60%.

8. The method for manufacturing an aluminum alloy fin material for brazing as claimed in claim 7, wherein said intermediate annealing, except for the final annealing, is applied using a heating furnace.

9. An aluminum alloy fin material for brazing, wherein the crystalline texture of the fin material, which is obtained by the manufacturing method as claimed in claim 7, comprises a fibrous texture.

10. A method for manufacturing an aluminum alloy fin material for brazing, comprising the steps of:

forming an ingot sheet, by casting a molten liquid of an aluminum alloy by a twin-roll continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, at least one of Zn of 3.0% by mass or less, In of 0.3% by mass or less, and Sn of 0.3% by mass or less, as well as at least one of Cu of 0.3% by mass or less, Cr of 0.15% by mass or less, Ti of 0.15% by mass or less, Zr of 0.15% by mass or less, and Mg of 0.5% by mass or less, with the balance being Al and inevitable impurities, wherein said twin-roll continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, and wherein two times or more of intermediate annealing are applied midway in said cold-rolling process, with said intermediate annealing including final intermediate annealing with a batch heating furnace in a temperature range of 300 to 450° C., and at a temperature that does not allow recrystallization to complete, thereby adjusting the rolling ratio in the cold-rolling, after the final intermediate annealing, to 10 to 60%.

11. The method for manufacturing an aluminum alloy fin material for brazing as claimed in claim 10, wherein said intermediate annealing, except for the final annealing, is applied using a heating furnace.

12. An aluminum alloy fin material for brazing, wherein the crystalline texture of the fin material, which is obtained by the manufacturing method as claimed in claim 10, comprises a fibrous texture.

13. A method for manufacturing an aluminum alloy fin material for brazing, comprising the steps of:

forming an ingot sheet, by casting a molten liquid of an aluminum alloy by a twin-roll continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, with the balance being Al and inevitable impurities, wherein said twin-roll continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, wherein one time or more of intermediate annealing is applied midway in said cold-rolling process, so that the final cold-rolling ratio becomes 10 to 95%, and wherein further annealing with a batch heating furnace is applied after said final cold-rolling, at a final sheet thickness in a temperature range of 300 to 450° C., and at a temperature that does not allow recrystallization to complete.

14. The method for manufacturing an aluminum alloy fin material for brazing as claimed in claim 13, wherein said intermediate annealing, except for the final annealing, is applied using a heating furnace.

15. An aluminum alloy fin material for brazing, wherein the crystalline texture of the fin material, which is obtained by the manufacturing method as claimed in claim 13, comprises a fibrous texture.

16. A method for manufacturing an aluminum alloy fin material for brazing, comprising the steps of:

forming an ingot sheet, by casting a molten liquid of an aluminum alloy by a twin-roll continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less of Si, as well as at least one of 3.0% by mass or less of Zn, 0.3% by mass or less of In, and 0.3% by mass or less of Sn, with the balance being Al and inevitable impurities, wherein said twin-roll continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, wherein one time or more of intermediate annealing is applied midway in said cold-rolling process, so that the final cold-rolling ratio becomes 10 to 95%, and wherein further annealing with a batch heating furnace is applied after said final cold-rolling, at a final sheet thickness in a temperature range of 300 to 450° C., and at a temperature that does not allow recrystallization to complete.

17. The method for manufacturing an aluminum alloy fin material for brazing as claimed in claim 16, wherein said intermediate annealing, except for the final annealing, is applied using a heating furnace.

18. An aluminum alloy fin material for brazing, wherein the crystalline texture of the fin material, which is obtained by the manufacturing method as claimed in claim 16, comprises a fibrous texture.

19. A method for manufacturing an aluminum alloy fin material for brazing, comprising the steps of:

forming an ingot sheet, by casting a molten liquid of an aluminum alloy by a twin-roll continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, as well as at least one of Cu of 0.3% by mass or less, Cr of 0.15% by mass or less, Ti of 0.15% by mass or less, Zr of 0.15% by mass or less, and Mg of 0.5% by mass or less, with the balance being Al and inevitable impurities, wherein said twin-roll continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, wherein one time or more of intermediate annealing is applied midway in said cold-rolling process, so that the final cold-rolling ratio becomes 10 to 95%, and wherein further annealing with a batch heating furnace is applied after said final cold-rolling, at a final sheet thickness in a temperature range of 300 to 450° C., and at a temperature that does not allow recrystallization to complete.

20. The method for manufacturing an aluminum alloy fin material for brazing as claimed in claim 19, wherein said intermediate annealing, except for the final annealing, is applied using a heating furnace.

21. An aluminum alloy fin material for brazing, wherein the crystalline texture of the fin material, which is obtained by the manufacturing method as claimed in claim 19, comprises a fibrous texture.

22. A method manufacturing an aluminum alloy fin material for brazing, comprising the steps of:

forming an ingot sheet, by casting a molten liquid of an aluminum alloy by a twin-roll continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, at least one of Zn of 3.0% by mass or less, In of 0.3% by mass or less, and Sn of 0.3% by mass or less, as well as at least one of Cu of 0.3% by mass or less, Cr of 0.15% by mass or less, Ti of 0.15% by mass or less, Zr of 0.15% by mass or less, and Mg of 0.5% by mass or less, with the balance being Al and inevitable impurities, wherein said twin-roll continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, wherein one time or more of intermediate annealing is applied midway in said cold-rolling process, so that the final cold-rolling ratio becomes 10 to 95%, and wherein further annealing with a batch heating furnace is applied after said final cold-rolling, at a final sheet thickness in a temperature range of 300 to 450° C., and at a temperature that does not allow recrystallization to complete.

23. The method for manufacturing an aluminum alloy fin material for brazing as claimed in claim 22, wherein said intermediate annealing, except for the final annealing, is applied using a heating furnace.

24. An aluminum alloy fin material for brazing, wherein the crystalline texture of the fin material, which is obtained by the manufacturing method as claimed in claim 22, comprises a fibrous texture.

25. A method for manufacturing an aluminum alloy fin material for brazing, comprising the steps of:

forming an ingot sheet, by casting a molten liquid of an aluminum alloy by a continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, with the balance being Al and inevitable impurities, wherein said continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, and wherein two times or more of intermediate annealing are applied midway in said cold-rolling process, with said intermediate annealing including final intermediate annealing with a heating furnace, in a temperature range of 300 to 450° C., and at a temperature that does not allow recrystallization to complete, thereby adjusting the rolling ratio in the cold-rolling, after the final intermediate annealing, to 10 to 60%.

26. A method for manufacturing an aluminum alloy fin material for brazing, comprising the steps of:

forming an ingot sheet, by casting a molten liquid of an aluminum alloy by a continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, as well as at least one of Zn of 3.0% by mass or less, In of 0.3% by mass or less, and Sn of 0.3% by mass or less, with the balance being Al and inevitable impurities, wherein said continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, and wherein two times or more of intermediate annealing are applied midway in said cold-rolling process, with said intermediate annealing including final intermediate annealing with a heating furnace, in a temperature range of 300 to 450° C., and at a temperature that does not allow recrystallization to complete, thereby adjusting the rolling ratio in the cold-rolling, after the final intermediate annealing, to 10 to 60%.

27. A method for manufacturing an aluminum alloy fin material for brazing, comprising the steps of:

forming an ingot sheet, by casting a molten liquid of an aluminum alloy by a continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, as well as at least one of Cu of 0.3% by mass or less, Cr of 0.15% by mass or less, Ti of 0.15% by mass or less, Zr of 0.15% by mass or less, and Mg of 0.5% by mass or less, with the balance being Al and inevitable impurities, wherein said continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, and wherein two times or more of intermediate annealing are applied midway in said cold-rolling process, with said intermediate annealing including final intermediate annealing with a heating furnace, in a temperature range of 300 to 450° C., and at a temperature that does not allow recrystallization to complete, thereby adjusting the rolling ratio in the cold-rolling, after the final intermediate annealing, to 10 to 60%.

28. A method for manufacturing an aluminum alloy fin material for brazing, comprising the steps of:

forming an ingot sheet, by casting a molten liquid of an aluminum alloy by a continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, at least one of Zn of 3.0% by mass or less, In of 0.3% by mass or less, and Sn of 0.3% by mass or less, as well as at least one of Cu of 0.3% by mass or less, Cr of 0.15% by mass or less, Ti of 0.15% by mass or less, Zr of 0.15% by mass or less, and Mg of 0.5% by mass or less, with the balance being Al and inevitable impurities, wherein said continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, and wherein two times or more of intermediate annealing are applied midway in said cold-rolling process, with said intermediate annealing including final intermediate annealing with a heating furnace in a temperature range of 300 to 450° C., and at a temperature that does not allow recrystallization to complete, thereby adjusting the rolling ratio in the cold-rolling, after the final intermediate annealing, to 10 to 60%.

29. A method for manufacturing an aluminum alloy fin material for brazing, comprising the steps of:

forming an ingot sheet, by casting a molten liquid of an aluminum alloy by a continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, with the balance being Al and inevitable impurities, wherein said continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, wherein one time or more of intermediate annealing is applied midway in said cold-rolling process, so that the final cold-rolling ratio becomes 10 to 95%, and wherein further annealing with a heating furnace is applied after said final cold-rolling, at a final sheet thickness in a temperature range of 300 to 450° C., and at a temperature that does not allow recrystallization to complete.

30. A method for manufacturing an aluminum alloy fin material for brazing, comprising the steps of:

forming an ingot sheet, by casting a molten liquid of an aluminum alloy by a continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less of Si, as well as at least one of 3.0% by mass or less of Zn, 0.3% by mass or less of In, and 0.3% by mass or less of Sn, with the balance being Al and inevitable impurities, wherein said continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, wherein one time or more of intermediate annealing is applied midway in said cold-rolling process, so that the final cold-rolling ratio becomes 10 to 95%, and wherein further annealing with a heating furnace is applied after said final cold-rolling, at a final sheet thickness in a temperature range of 300 to 450° C., and at a temperature that does not allow recrystallization to complete.

31. A method for manufacturing an aluminum alloy fin material for brazing, comprising the steps of:

forming an ingot sheet, by casting a molten liquid of an aluminum alloy by a continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, as well as at least one of Cu of 0.3% by mass or less, Cr of 0.15% by mass or less, Ti of 0.15% by mass or less, Zr of 0.15% by mass or less, and Mg of 0.5% by mass or less, with the balance being Al and inevitable impurities, wherein said continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, wherein one time or more of intermediate annealing is applied midway in said cold-rolling process, so that the final cold-rolling ratio becomes 10 to 95%, and wherein further annealing with a heating furnace is applied after said final cold-rolling, at a final sheet thickness in a temperature range of 300 to 450° C., and at a temperature that does not allow recrystallization to complete.

32. A method for manufacturing an aluminum alloy fin material for brazing, comprising the steps of:

forming an ingot sheet, by casting a molten liquid of an aluminum alloy by a continuous cast-rolling method; and cold-rolling the ingot sheet, to prepare the fin material, with the aluminum alloy comprising more than 0.6% by mass, and 1.8% by mass or less, of Mn, more than 1.2% by mass, and 2.0% by mass or less, of Fe, and more than 0.6% by mass, and 1.2% by mass or less, of Si, at least one of Zn of 3.0% by mass or less, In of 0.3% by mass or less, and Sn of 0.3% by mass or less, as well as at least one of Cu of 0.3% by mass or less, Cr of 0.15% by mass or less, Ti of 0.15% by mass or less, Zr of 0.15% by mass or less, and Mg of 0.5% by mass or less, with the balance being Al and inevitable impurities, wherein said continuous cast-rolling is applied under the conditions of a molten liquid temperature of 700 to 900° C., a roll press load of 5,000 to 15,000 N per 1-mm width of the ingot sheet, a casting speed of 500 to 3,000 mm/min, and a thickness of the ingot sheet of 2 to 9 mm, wherein one time or more of intermediate annealing is applied midway in said cold-rolling process, so that the final cold-rolling ratio becomes 10 to 95%, and wherein further annealing with a heating furnace is applied after said final cold-rolling, at a final sheet thickness in a temperature range of 300 to 450° C., and at a temperature that does not allow recrystallization to complete.

* * * * *